US008308173B2

(12) United States Patent
Pazhoor

(10) Patent No.: US 8,308,173 B2
(45) Date of Patent: Nov. 13, 2012

(54) PORTABLE MULTI-STATION VOTING BOOTH CART

(75) Inventor: Mohamed Pazhoor, West Palm Beach, FL (US)

(73) Assignee: Naztec International Group, LLC, West Palm Beach, FL (US)

( * ) Notice: Subject to any disclaimer, the term of this patent is extended or adjusted under 35 U.S.C. 154(b) by 0 days.

(21) Appl. No.: 13/192,232

(22) Filed: Jul. 27, 2011

(65) Prior Publication Data

US 2011/0285100 A1 Nov. 24, 2011

Related U.S. Application Data

(63) Continuation-in-part of application No. 12/730,342, filed on Mar. 24, 2010, now Pat. No. 8,006,986.

(51) Int. Cl.
*B62B 3/00* (2006.01)

(52) U.S. Cl. ..... 280/47.34; 280/47.35; 312/196; 312/122; 312/195; 312/294

(58) Field of Classification Search ..... 280/47.34, 280/47.35, 47.39, 79.11, 79.2; 235/57, 386; 312/195–196, 122, 294, 317.1, 321.5, 334.21
See application file for complete search history.

(56) References Cited

U.S. PATENT DOCUMENTS

| | | | | |
|---|---|---|---|---|
| 2,054,102 | A | 9/1936 | Shoup et al. | |
| 2,354,743 | A | 8/1944 | Douglas et al. | |
| 2,778,704 | A | 1/1957 | Joachim | |
| 3,178,107 | A | 4/1965 | Fagan | |
| 3,333,766 | A | 8/1967 | Crossland et al. | |
| 3,550,540 | A | 12/1970 | Albrecht et al. | |
| 3,652,012 | A | 3/1972 | Harris et al. | |
| 4,253,715 | A | 3/1981 | Greiner | |
| 4,377,367 | A | 3/1983 | Smith | |
| 4,445,731 | A | 5/1984 | Ahmann | |
| 4,484,787 | A | 11/1984 | Stephens | |
| 4,488,034 | A | 12/1984 | Stephens et al. | |
| 4,569,564 | A | 2/1986 | Ahmann | |
| 4,660,904 | A | 4/1987 | Stephens | |
| 4,712,757 | A | 12/1987 | Ahmann | |
| 5,072,999 | A | 12/1991 | Trotta | |
| 5,190,302 | A | 3/1993 | Trotta | |
| 5,275,365 | A | 1/1994 | Gerbel et al. | |
| 5,348,324 | A | 9/1994 | Trotta | |
| 5,531,295 | A * | 7/1996 | Kopman et al. | 188/21 |
| 5,666,765 | A | 9/1997 | Sarner et al. | |
| 6,053,588 | A | 4/2000 | Biggel et al. | |
| 6,129,366 | A | 10/2000 | Dettmann et al. | |
| 6,206,495 | B1 * | 3/2001 | Peterson | 312/283 |
| 6,601,861 | B1 | 8/2003 | Dettmann et al. | |

(Continued)

*Primary Examiner* — John Walters
*Assistant Examiner* — James Triggs
(74) *Attorney, Agent, or Firm* — McHale & Slavin, P.A.

(57) ABSTRACT

A portable voting booth having multiple voting stations or trays combined with a single voting cart. The voting cart includes portable voting booth trays that can be deployed from the voting cart with privacy shields that are formed integral and can be erected for privacy. Voting trays are placed at various levels to accommodate individuals of various heights, including individuals utilizing wheelchairs while also providing a compact storage configuration. Beneath the retractable voting stations is an area for storage of voting materials, allowing the materials to be assembled in a remote location and sealed within the utility cart for storage. The cart then can be moved to the particular locations for the voting procedure. Upon completion of the voting process the cart can be resealed with the cast ballots. Tracking systems are optionally employed to track the cart and/or contents of the cart.

25 Claims, 40 Drawing Sheets

U.S. PATENT DOCUMENTS

| | | | |
|---|---|---|---|
| 6,634,668 | B2 | 10/2003 | Urffer, III et al. |
| 6,711,980 | B2 | 3/2004 | Kropf |
| 6,926,155 | B2 | 8/2005 | Vogel |
| 7,044,569 | B1 | 5/2006 | Relyea et al. |
| D573,773 | S | 7/2008 | Wilson et al. |
| 7,398,914 | B1 | 7/2008 | Baum |
| 7,552,931 | B2 | 6/2009 | Liao |
| D603,183 | S | 11/2009 | Abel et al. |
| D603,184 | S | 11/2009 | Abel et al. |
| D603,621 | S | 11/2009 | Abel et al. |
| D604,022 | S | 11/2009 | Abel et al. |
| 7,654,457 | B2 | 2/2010 | Wilson et al. |
| 7,895,954 | B2 | 3/2011 | Abel et al. |
| 8,006,986 | B1 | 8/2011 | Pazhoor |
| 2002/0092443 | A1 | 7/2002 | Grant |
| 2002/0106620 | A1 | 8/2002 | Barnum |
| 2004/0056093 | A1 | 3/2004 | McClure et al. |
| 2006/0055135 | A1 | 3/2006 | Tracewell et al. |
| 2008/0116270 | A1* | 5/2008 | Wilson et al. ..... 235/386 |
| 2009/0166992 | A1 | 7/2009 | Abel et al. |

* cited by examiner

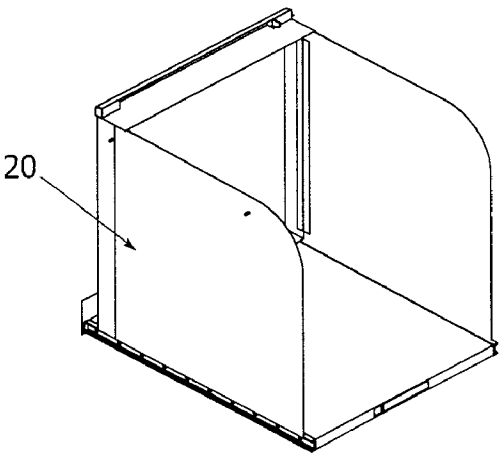
Fig. 44
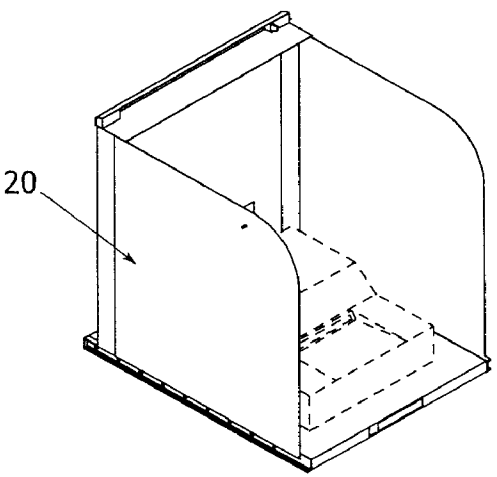
Fig. 45
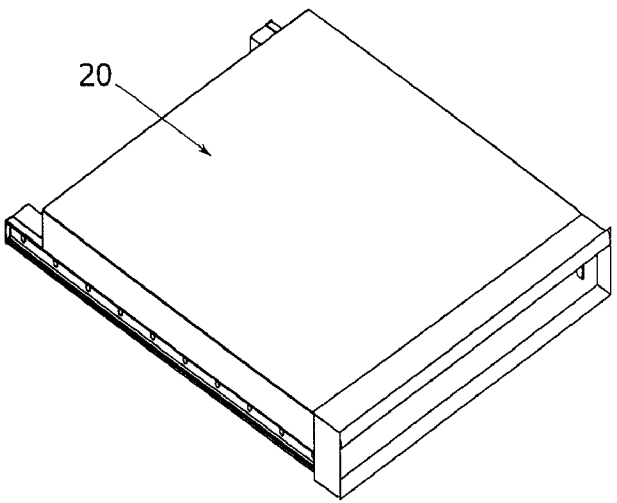
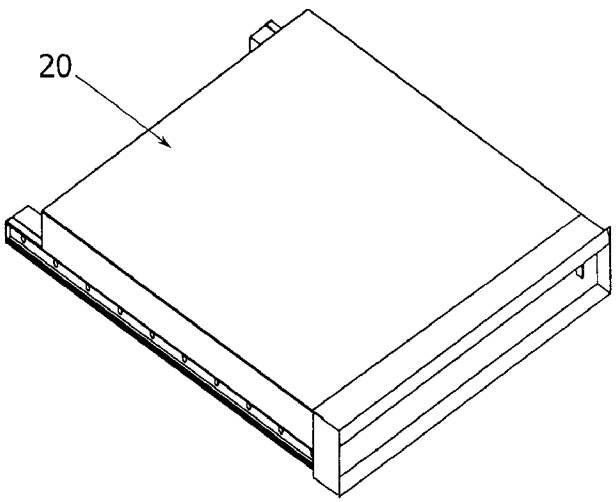

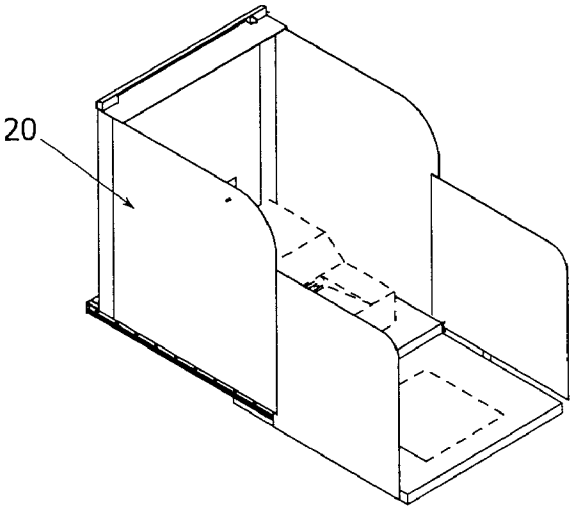
Fig. 46
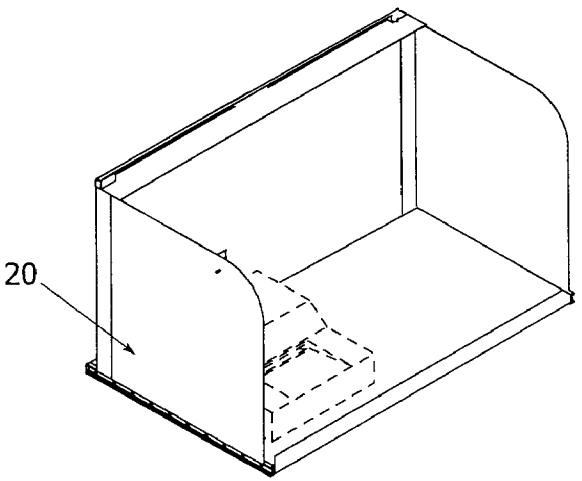
Fig. 47
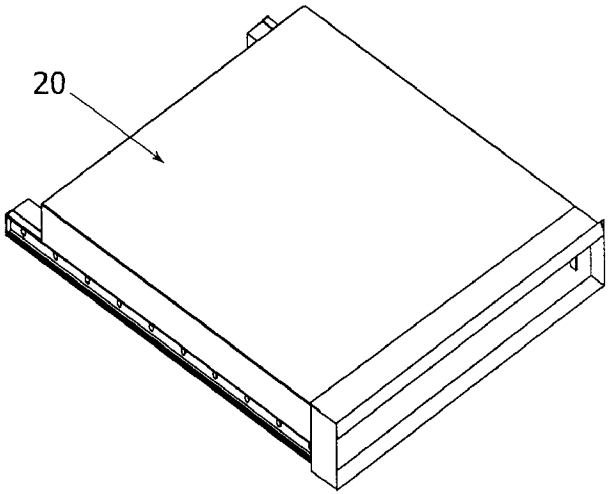
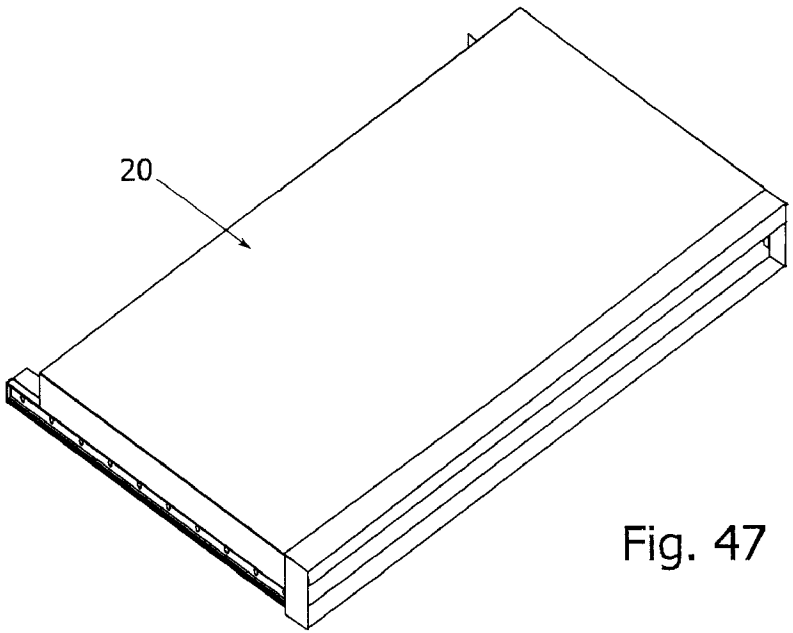

PORTABLE MULTI-STATION VOTING BOOTH CART

CROSS-REFERENCE TO RELATED APPLICATIONS

This application is a continuation-in-part of U.S. patent application Ser. No. 12/730,342, filed Mar. 24, 2010 now U.S. Pat. No. 8,006,986, entitled MULTI-STATION VOTING BOOTH WITH STORAGE/UTILITY CART, the entirety of which is incorporated herein by reference.

FIELD OF THE INVENTION

This invention relates to the field of portable voting booths, and in particular to multi-station portable voting booths including a storage cart.

BACKGROUND OF THE INVENTION

Voting booths provide an area of privacy for those exercising the right to vote. Whether the vote is for electing an individual to a position of leadership, or deciding whether to tax cigarettes, the right to vote is a most private matter. For this reason, voting booths of most every configuration can be found; all with a purpose of providing an area of privacy for the individual exercising their freedom to vote. For instance, stand alone units are well known wherein curtains are hung around the individual for privacy. More elaborate booths might have computer terminals built into the stands.

Most every voting booth is portable as they are used only temporarily. The voting process is performed on a predefined date, and depending on the type of election, might require assembly once, twice or multiple times per year. Due to the amount of people that are involved in voting, a school or church having a large area is typically employed. For instance, a school cafeteria may be employed wherein portable stands are assembled and made available for the voting public. Without such devices the election process would fail to render the actual beliefs of the voters.

There are numerous types of voting booths, each having a configuration that permits various degrees of privacy. One of the problems with the currently available portable voting booths is their inability to store critical materials necessary for a particular election. This includes items such as the ballots that will be employed by the voting public as well as the ballots after they have been cast. For the integrity of the election process, the ballots must be accounted for both before and after the vote, and the voting booth must maintain a minimum of privacy so that an individual does not feel obligated to vote in any manner that is contrary to their own belief.

One shortcoming associated with current systems relates to voter privacy. Current systems require the voter to mark His/Her ballot in a voting booth, and thereafter feed the ballot into the ballot scanner/ballot counter/ballot tabulator which is kept in a different location. Voters often view the movement required to transfer the ballot from location to location as a threat to voter privacy. Often paper folders or the like are given to voters in an attempt to conceal the marked ballot. However, the marked ballot must ultimately be revealed to bystanders when fed into the tabulating machine. Thus, there remains a need in the art for a voting booth which integrates a ballot vote marking table, optical ballot scan counter, and ballot box within one location to eliminate the need for transferring a marked ballot to a different location.

Another shortcoming associated with current systems relates to transportation and the associated accounting of voting materials to minimize voter fraud. Transportation of booths, scanners, ballots and the like necessarily requires the equipment to be surrendered to others, increasing the chance of fraudulent voting. Tracking the equipment becomes a logistical nightmare as the equipment is transferred to transportation to different locations starting from a warehouse to the election voting places like schools, churches, etc., carrying all the important accessories for voting. Ballots and the like may easily be stolen for ballot box stuffing. Therefore, there exists a need in the art for a voting booth system suitable for securing all required voting supplies under seal while the voting booth is in transit or storage. The voting booth system should also include electronic real time tracking of the voting booth and any voting supplies or equipment stored within the voting booth. The voting booth may include more than one tracking system to provide redundancy for added security or monitoring by more than one agency.

Yet another shortcoming associated with the prior art relates to the provision of instructions to voters. Presently, voting booths have instructions for voting in the form of a paper (instruction sheet) that is typically posted in a plastic sleeve along one wall of the carrel portion of the voting booth. Voters often take these sheets to confuse subsequent voters or occasional last minute instructions need to be added to the list. Thus, there is a need in the election industry to provide voting instruction using a LCD display screen which provides instruction in a more user friendly format that is difficult to alter or take, and may be updated as required from a central or local database.

Thus, what is needed in the art is a multi-station voting booth system that is easily stored, transported, erected, and can be used to secure pre- and post-voting materials.

SUMMARY OF THE INVENTION

The instant invention is a portable voting booth system that incorporates multiple voting stations in a single voting utility/storage type cart. In addition, the voting cart is specifically adapted for holding voting equipment and/or materials both before and after the voting process. The voting cart includes a plurality of portable voting booth stations or trays that can be deployed from the voting cart with carrel type privacy shields that are integrally hinged to the stations or trays and can be erected quickly for privacy. Magnets, hook and loop, spring pins or the like may be utilized to secure the erect carrel shields to the tray. A rectangular shaped cart may include up to eight privacy booths or trays placed at various levels of height with respect to the floor. This construction not only allows for compactness, but further allows various accommodation of individuals that are utilizing a wheelchair, as well as individuals of different height. In addition, this design permits voting trays to be configured in various ways within the same voting cart to accommodate a wide variety of voting regulations.

Beneath the retractable voting stations are areas for storage of voting materials such as, but not limited to, ballots, pencils, pens, scanners, counters, instruction sheets, voting location identification etc. This construction allows the equipment and/or materials to be assembled in a remote warehouse location and sealed within the voting booth system for storage and transport. The voting booth system can then be moved to the desired locations for the voting procedure. At the voting location, the seal can be broken and the voting equipment and voting materials accessed. Upon completion of the voting process, the unused voting materials as well as marked ballots, voting equipment and the like may be placed within the voting cart with provisions to reseal the cart and allow transportation to another location or to the ballot tally area.

At least one embodiment includes electronic tracking of the voting cart, as well as voting equipment and materials alike. This helps the user to pinpoint the precise location, time/date and motion data points of the voting cart, and for enhanced security features, the location of the multi-station voting cart can be tracked with remote asset management solutions. In some embodiments, the multi-station voting cart will be fitted with a remote monitoring unit which continuously, in real time, audits the cart's location and contents. The real time tracking incorporates standard electronic communication technologies such as RF communications, Global Positioning Systems (GPS), Global System Mobile Communication (GSM), Code Division Multiple Access (CDMA), and Worldwide Inter-portability for Microwave Access (WEiMAX). In some embodiments, the voting cart communicates and updates a central server or a logistics management system located in a remote location. Reports based on the information can be customized for specific needs of the customer. Real time tracking may also include GEO fencing which may be utilized to electronically limit access to the internal storage area of the voting cart and may be utilized to notify the user when the voting cart leaves a predefined virtual perimeter.

Accordingly, it is an objective of the present invention to provide a voting booth system having a wheeled voting cart that includes drawer style pull out deployment of multiple voting stations or trays.

It is a further objective of the present invention to provide a voting cart wherein the individual voting station or trays include hingedly connected folding carrel type privacy walls that can be erected without tools and folded into a compact and collapsed configuration after use for ease of storage.

It is still another objective of the present invention to provide a voting cart that includes a storage area in combination with the drawer type voting trays for placement of pre- and post-voting ballot materials in a securable location.

It is yet another objective of the present invention to provide a voting cart that can be easily moved, and upon positioning may be locked in place by locking a plurality of supporting wheels in position.

It is yet still another objective of the present invention to provide a voting cart that provides voting stations or trays positioned at various heights wherein individuals that are wheelchair bound or that are quite tall may easily access a voting station or tray.

It is yet still another objective of the present invention to provide a voting cart that is constructed and arranged to be configured in various arrangements depending upon the amount of individuals expected or the particular location, spatial restrictions or local voting regulations and/or rules.

It is yet still another objective of the present invention to provide a voting cart that is strong and durable to withstand countless moves across most any type of surface and has impact edges so as to prevent marring of walls or other voting carts.

It is yet still another objective of the present invention to provide a voting cart having hingedly connected folding carrel type privacy shields that can be secured in an upright deployed position by the use of spring pins, magnets, hook and loop or the like to eliminate the need for assembly tools or assembly instructions by providing voting stations that are adherently easy to erect through simplicity of design.

It is yet still another objective of the present invention to provide individual voting stations or trays that include active low energy type lighting at the individual stations.

It is still yet another objective of the present invention to provide a voting station or tray that is suitably sized to integrate the ballot marking area on the tray and an optical ballot scanner on a single or adjacent tray to increase voter privacy.

It is still yet another objective of the present invention to provide a voting cart that incorporates the use of electronic access systems for security. Real time tracking incorporates standard electronic communication technologies such as RF communications, Global Positioning Systems (GPS), Global System Mobile Communication (GSM), Code Division Multiple Access (CDMA), and Worldwide Inter-portability for Microwave Access (WEiMAX).

It is still yet another objective of the present invention to incorporate an electronic sensor based system to quantify and/or identify materials an/or equipment inside the storage cart which are critical during Election Day.

It is still yet another objective of the present invention to provide a voting cart that includes a sensor system that electronically cooperates with a tracking system to alert the user of missing or deficient item(s) to reduce Election Day issues.

It is still yet another objective of the present invention to incorporate the use of electronic monitor screens of various sizes to display voter information and specific voter instructions in individual voting stations.

It is still yet another objective of the present invention to provide a multi-station voting cart that incorporates a central braking system for locking and unlocking the brakes on all of the wheels utilized on the voting cart.

It is still yet another objective of the present invention to provide a voting cart having an active lighting system at each voting station or tray, whereby light intensity, direction and time of duration may be programmed and may further include motion sensors for control of power usage.

It is still yet another objective of the present invention to provide a voting cart having a storage area that includes height and width adjustable shelves for accommodating transportation of various equipment and voting materials.

It is still yet another objective of the present invention to provide a voting cart having a plurality of voting trays each including a motion sensor LED light.

It is still yet another objective of the present invention to provide a voting cart that includes an automatic motor driven/spring loaded voting tray extraction/ejection system for each of the individual voting stations.

It is still yet another objective of the present invention to provide a voting cart that utilizes a key locking system for deploying/collapsing each of the individual voting trays in the event of a spring latch failure.

It is still yet another objective of the present invention to provide a voting cart that incorporates a storage door access lock to prevent opening of a storage compartment door if a voting tray is in a deployed or open position.

It is still yet another objective of the present invention to provide a voting cart that utilizes an on/off switch to control operation of the LED light for the individual voting booths/optical scanner counters.

It is still yet another objective of the present invention to provide a voting cart that includes edge liners or bumpers to avoid scratches/damages to the paint of the unit while it is in storage or being transported to a location.

It is still yet another objective of the present invention to provide a voting cart that includes a central power for providing power to the various electric and electronic components of the voting cart and/or voting equipment.

It is still yet another objective of the present invention to provide a voting cart that includes at least one emergency off button for the central power system to shut down power to the voting cart and/or equipment connected to the central power system.

It is still yet another objective of the present invention to provide a voting cart that includes a ballot collection box in the storage area of the voting cart.

It is still yet another objective of the present invention to provide a voting cart that incorporates retractable or foldable handles to provide a compact position for storage or transportation.

Other objectives and advantages of this invention will become apparent from the following description taken in conjunction with the accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE DRAWINGS

FIG. 44 is a perspective view of one embodiment of a voting tray illustrated in a storage and a deployed state;

FIG. 45 is a perspective view of one embodiment of a voting tray illustrated supporting a scanner device;

FIG. 46 is a perspective view illustrating one embodiment of a voting tray that includes a secondary tray in a storage and deployed state;

FIG. 47 is a perspective view illustrating one embodiment of a voting tray having sufficient width to support a scanning device and a voting area.

DETAILED DESCRIPTION OF THE PREFERRED EMBODIMENT

Figure 1:
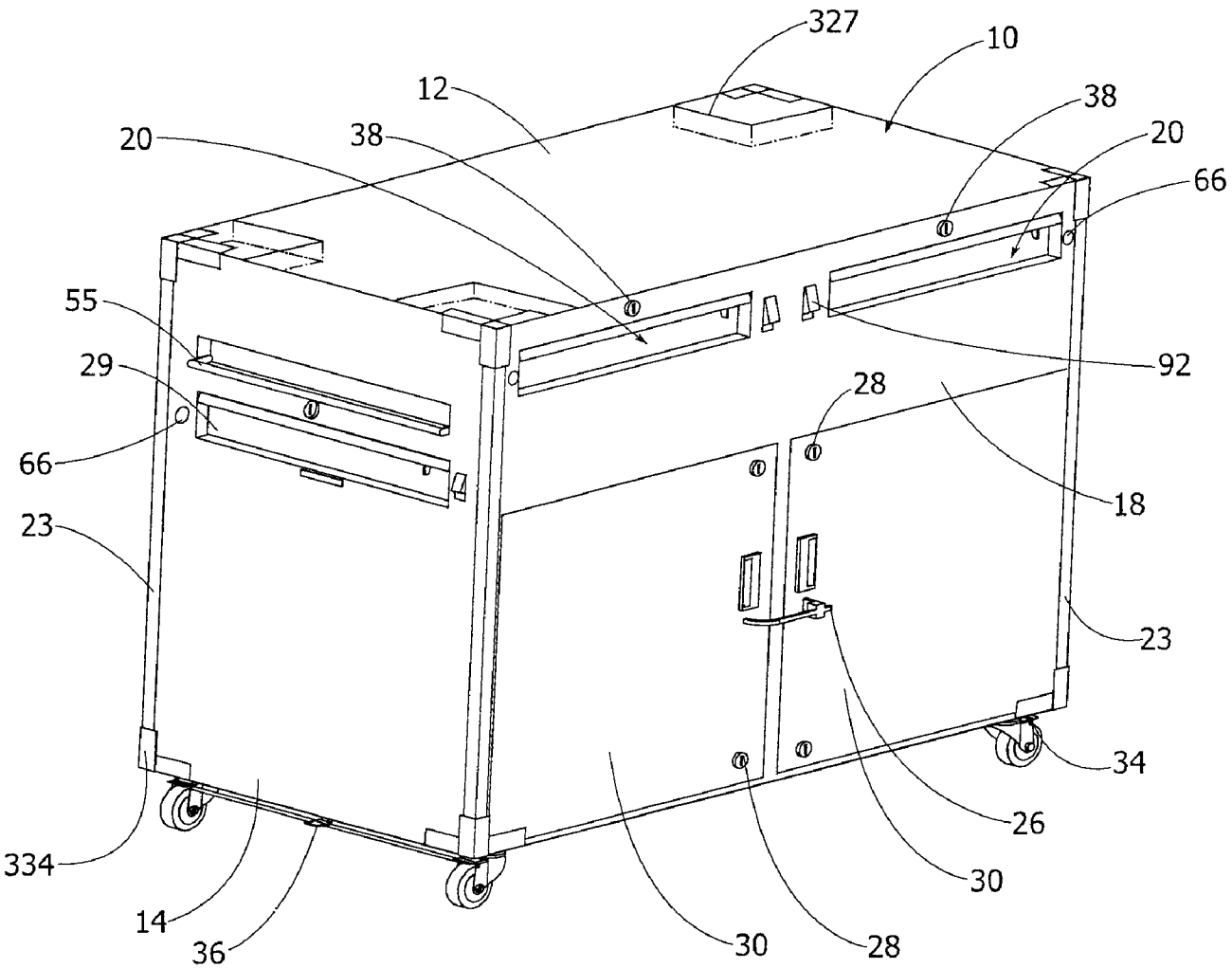
FIG. 1 is a perspective view of the multi-station voting cart of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
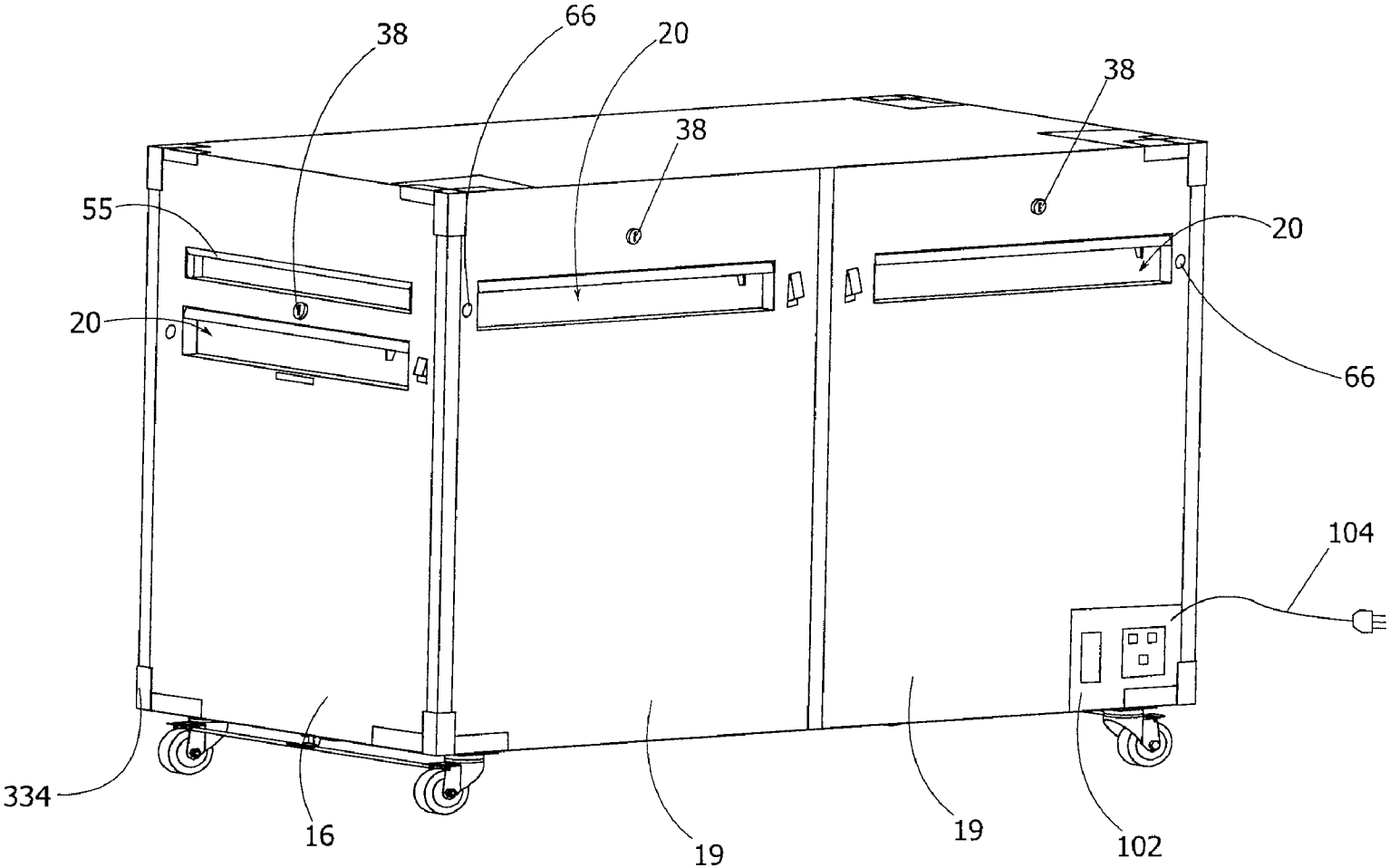
FIG. 2 is a rear perspective view thereof.
Figure 3:
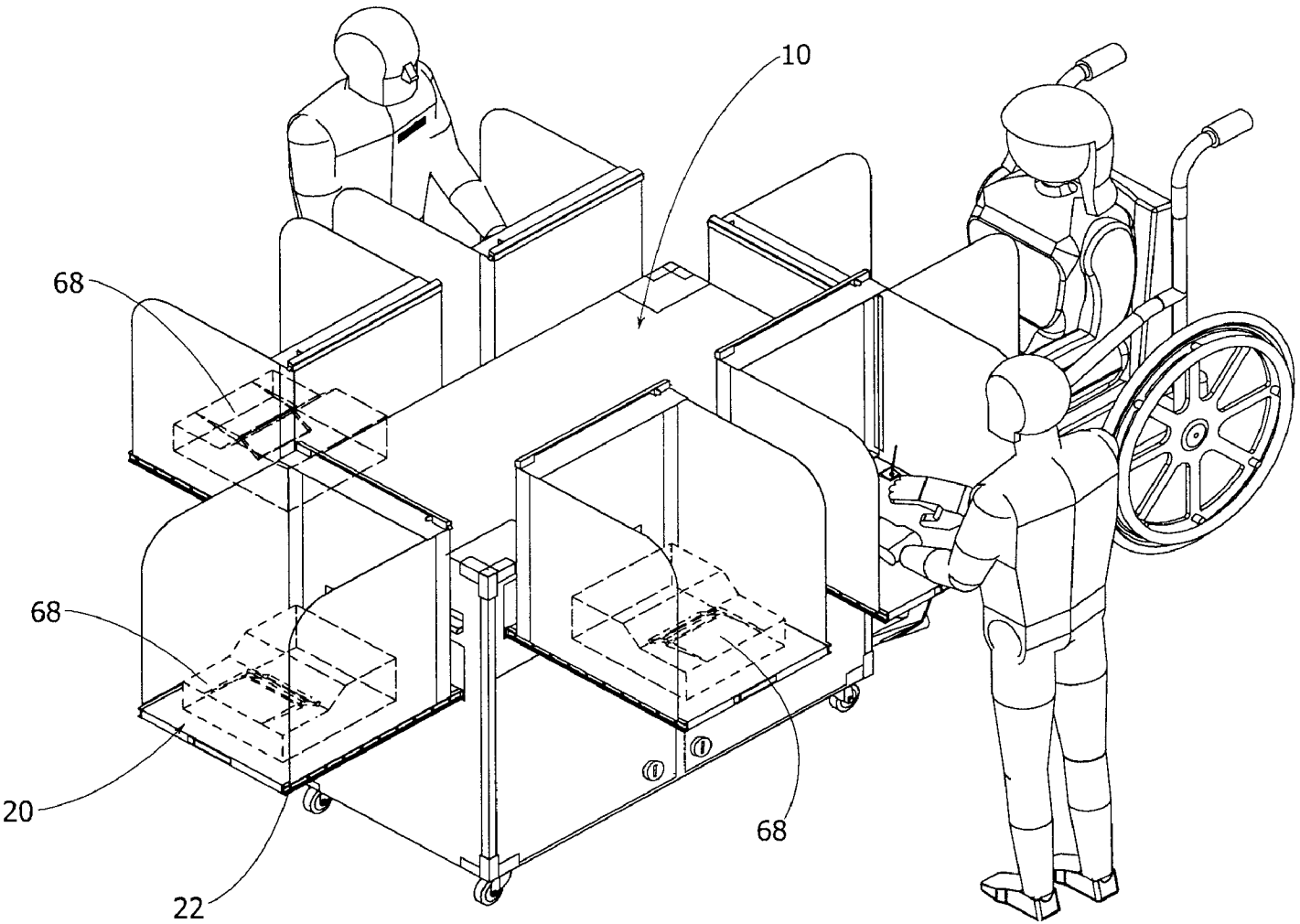
FIG. 3 is a perspective view of the present invention with the voting tray(s) deployed.
Figure 4:
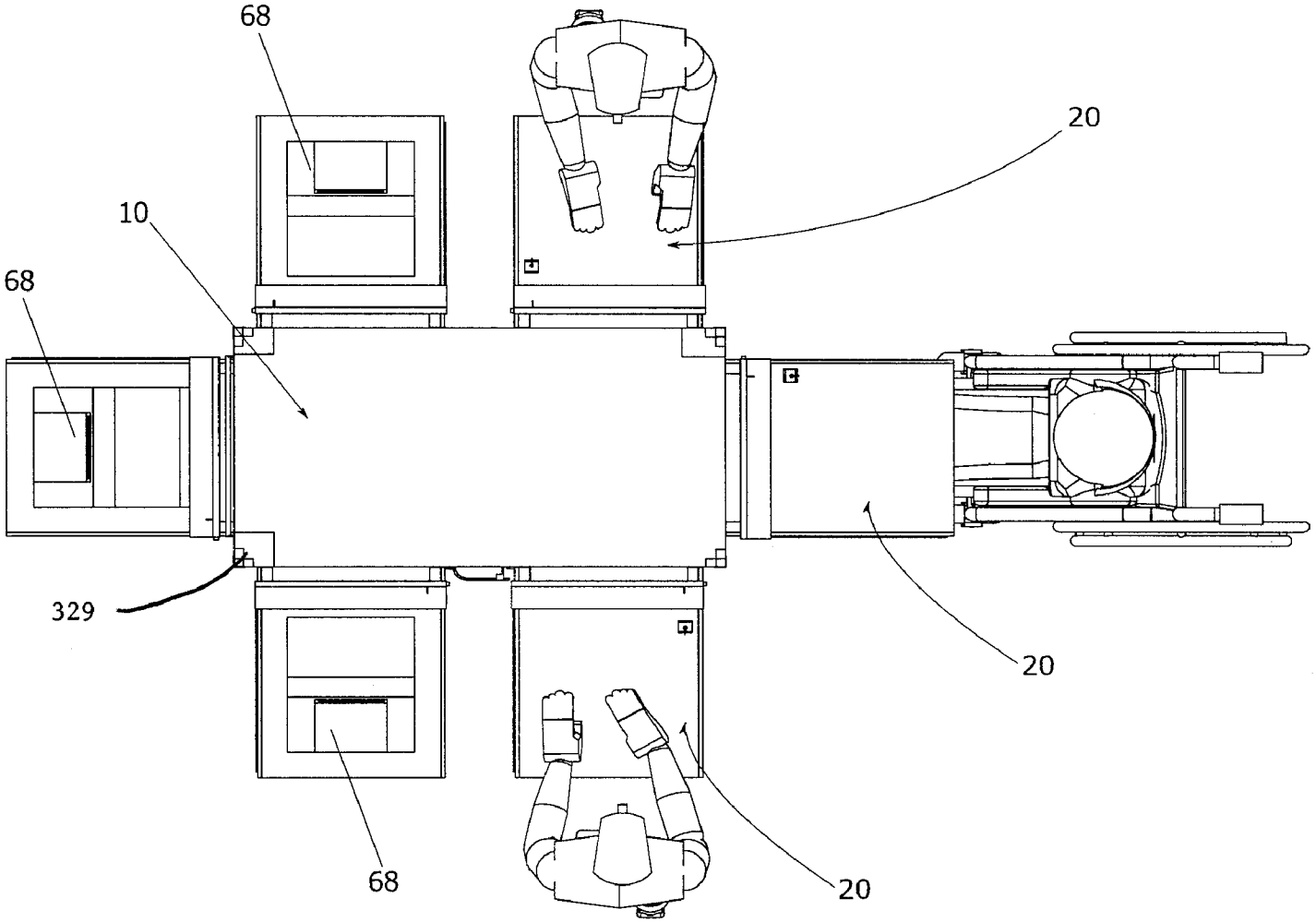
FIG. 4 is a top view of the embodiment illustrated in FIG. 3.
Figure 23:
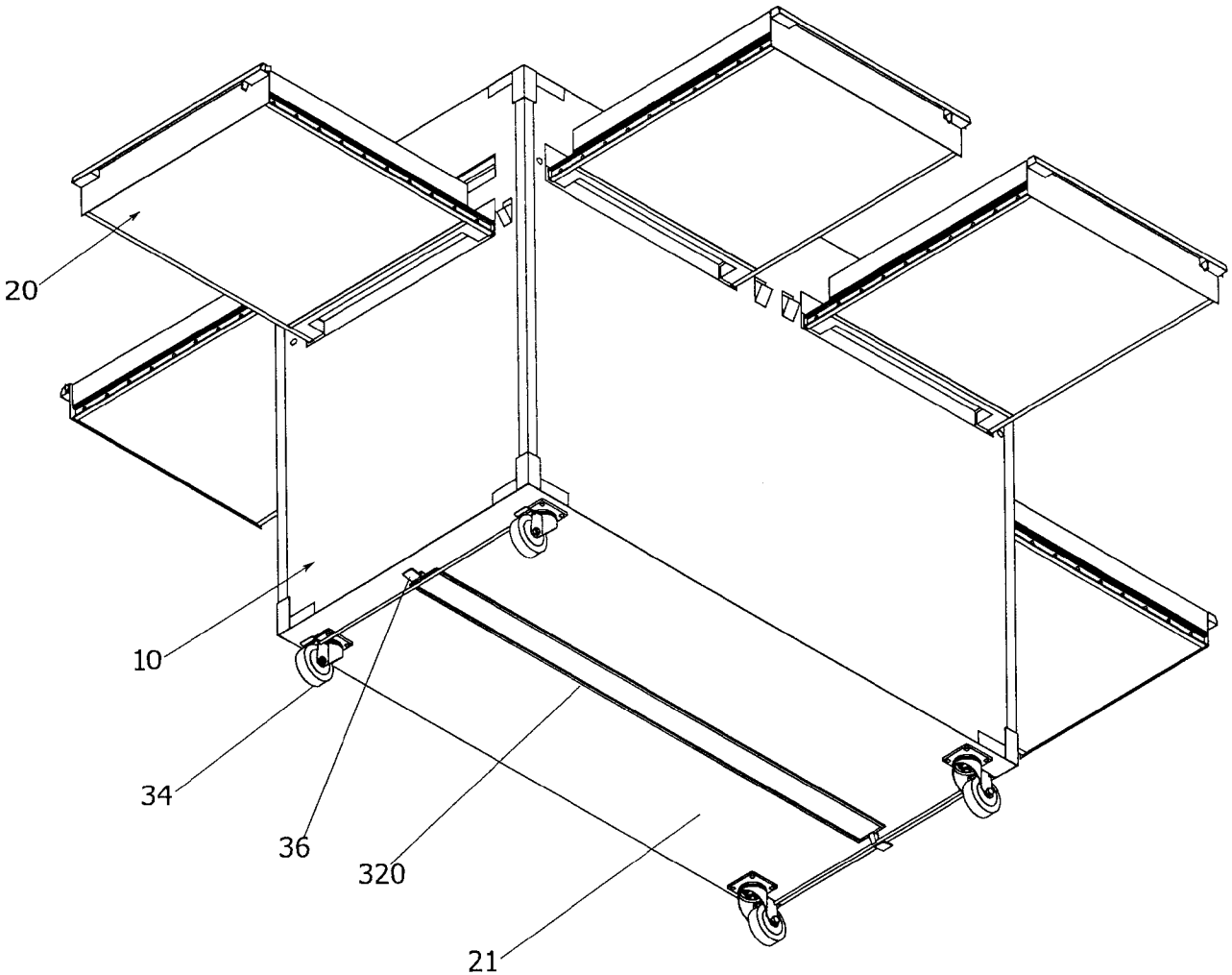
FIG. 23 is a perspective view of one embodiment of the underside of the present invention.

Referring to FIGS. 1 and 2, front and rear perspective views of the multi-station voting cart 10 are illustrated. The voting cart includes a top panel 12, side panels 14 and 16, front panel 18, rear panel 19 and bottom panel 21 (FIG. 23). The panels are secured to a structural frame 23 that provides rigidity to the voting cart and allows the voting cart to support a substantial amount of weight. Wheels 34, preferably castor type, are secured to the structural frame and support the cart to allow for transportation of the cart to various locations. The front 18, side, 14, 16, and rear panel 19 are each provided with tray openings 29 that are sized and shaped to allow passage of voting stations, hereinafter referred to as trays 20. The trays 20 are mounted upon sliding tracks 22 (FIG. 3) so that the trays can be slid outward to a deployed position for use as a voting station and thereafter be slid inward to a storage position within the confines of the voting cart 10. In a most preferred embodiment, the trays are positioned at different heights amongst the different panels to provide various advantages. First, staggering the heights of the trays allows for a more compact configuration while the trays are in the storage position thereby allowing more trays 20 to be positioned around the voting cart 10. Second, the trays may be positioned at a lower height for handicap voters, such as along the end panels as illustrated in the figures, while the remaining trays can be positioned at a suitable height for non-handicapped voters or even extremely tall or short voters providing better access to a wider variety of voters. It should also be noted that while a sliding arrangement of the voting trays are illustrated a pivotal connection of the trays could alternatively be employed without departing from the scope of the invention.

A tracking system 327 is provided to monitor the location of the cart. The tracking system is preferably a GPS based system but could be any other type of tracking system. The tracking system 327 can also include a tracking system for the stationeries, accessories, ballots, etc. contained within the cart. For example, an RFID tag can be placed on individual items such as stationeries, accessories, ballots, etc. or groups of items. A RFID reader would be provided in conjunction with system 327 to monitor the items with the RFID tags. A Light Dependent Resistor (LDR) system, which employs a light beam, could also be employed to monitor the items. Also, a weight sensor could be employed to monitor the items contained within the cart. The tracking system can be designed to communicate with cellular phone or a computer so that an individual can track the cart and its contents by using their cellular phone or computer. The electronic sensor which tracks all of the items within the cart is customer configurable to suit the individual needs and requirements of the customer. The central power module provides power to the ballot scanners, the GPS tracker, the electronic sensors, the electromechanical sensors, the LED light modules and other systems and accessories. The LCD screen display 86 can be used at a warehouse to provide critical data related to the ballot scanner, paper ballots, ballot boxes, election stationeries, and other accessories.

Figure 7:
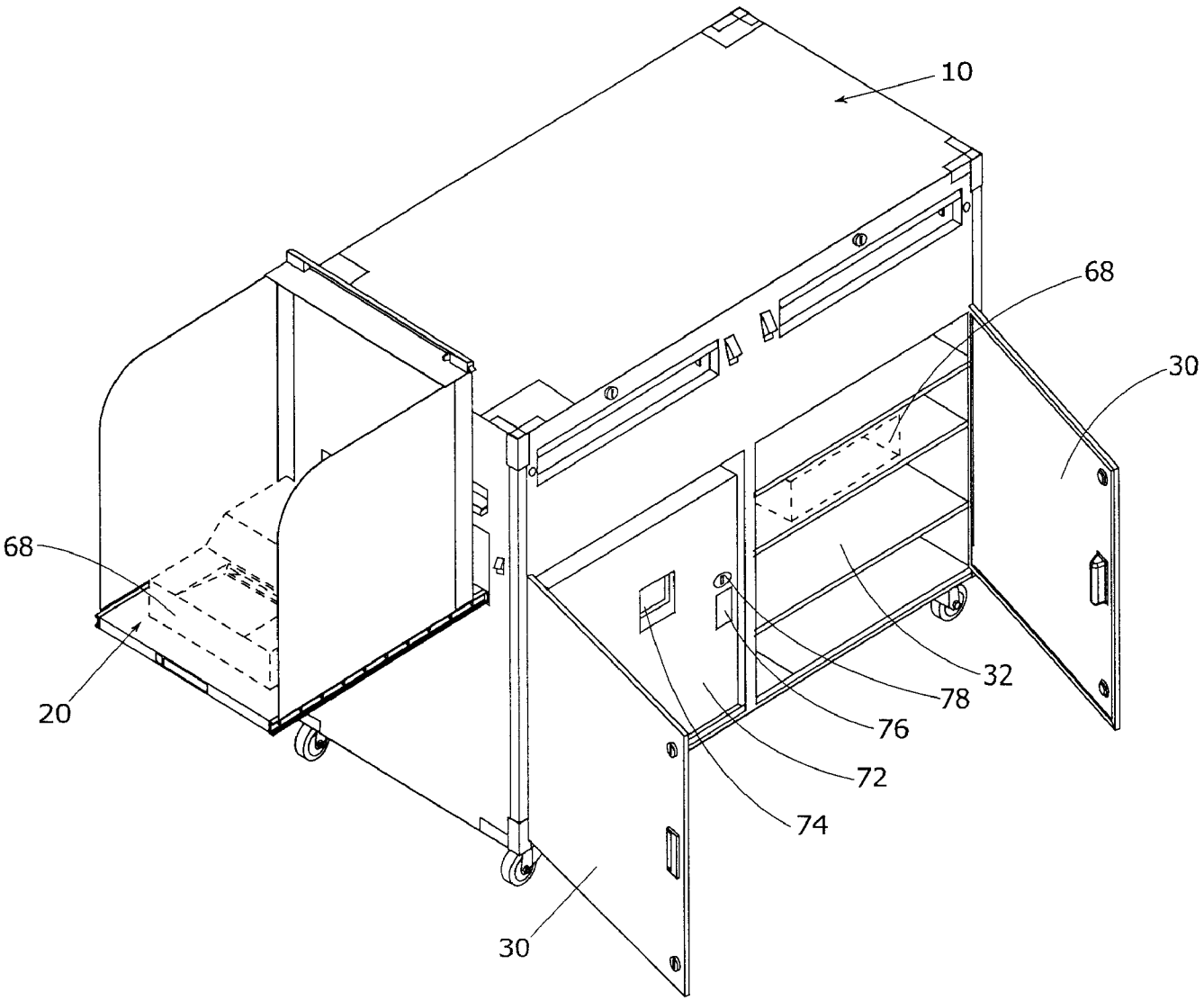
FIG. 7 is a perspective view of one embodiment of the present invention with only one voting tray deployed and the doors open to the storage area.
Figure 8:
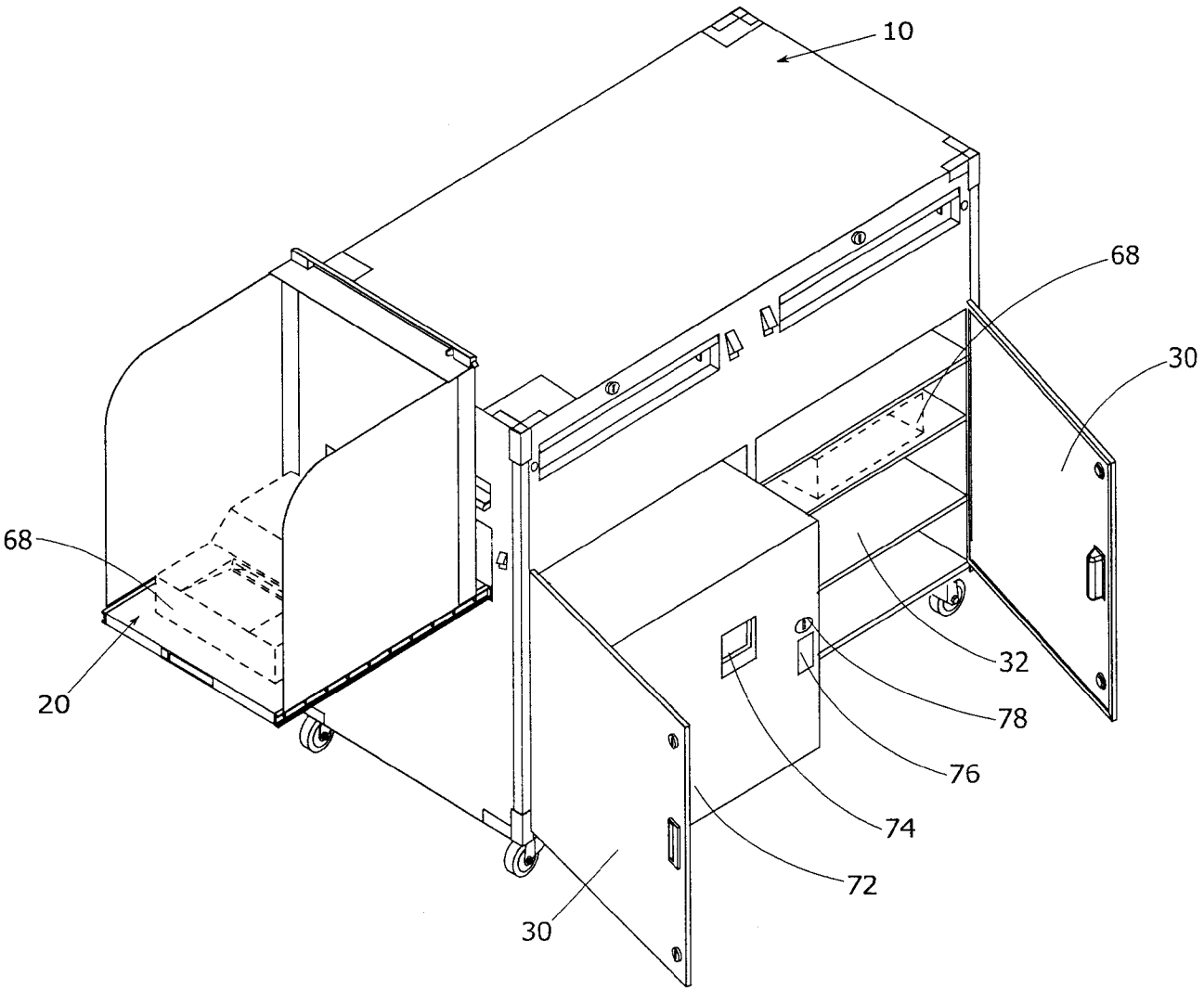
FIG. 8 is a front perspective view of one embodiment of the present invention.

Still referring to FIGS. 1 and 2, a handle 55 is provided along each side to move the voting cart 10 from one place to another. In a preferred embodiment, the handle is constructed and arranged to pivot or telescope into a storage position, as illustrated in FIG. 2. This construction permits a more compact configuration for storage and transport as well as removing obstruction to voting trays 20 positioned at the side panel position. Fenders or edge liners 334 are provided along each corner of the structural frame 23 to allow abutment of a plurality of voting carts 10 for transport or storage. The edge liners prevent marring or marking of paint on the voting cart as well as walls that may be contacted during transport or use of the voting cart. At least one, and more preferably a pair of access doors 30 are provided to access storage area 32 (FIGS. 7-9) within the confines of the voting cart 10. The access doors are provided with door key locks 28 and may further include a seal 26 that may be mechanical or electronic in nature. The seal is generally constructed and arranged to prevent entry into the storage area 32 and to provide notice if the storage area has been accessed without authorization.

Still referring to FIG. 2, positioned at the rear portion of the voting cart 10 is a power system 102. The power system is constructed and arranged to power all electrical requirements of the voting cart for extended periods of time and may include one or more batteries and inverter, transformer or high frequency ballast for powering the various devices. In one embodiment, a power cord 104 may be pulled outwardly from the voting cart and extended to an ordinary power outlet. In this manner, power may be easily routed to the various electrical devices utilized on the voting cart. The battery power may provide electricity to the devices in the event that power is not available at the voting site or in the event of a power outage.

Figure 27B:
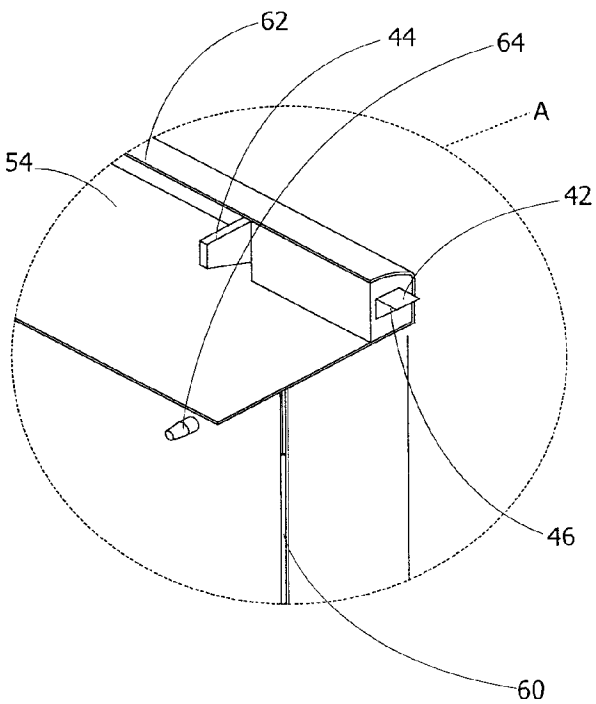
FIG. 27B is an enlarged portion of FIG. 27A.
Figure 27A:
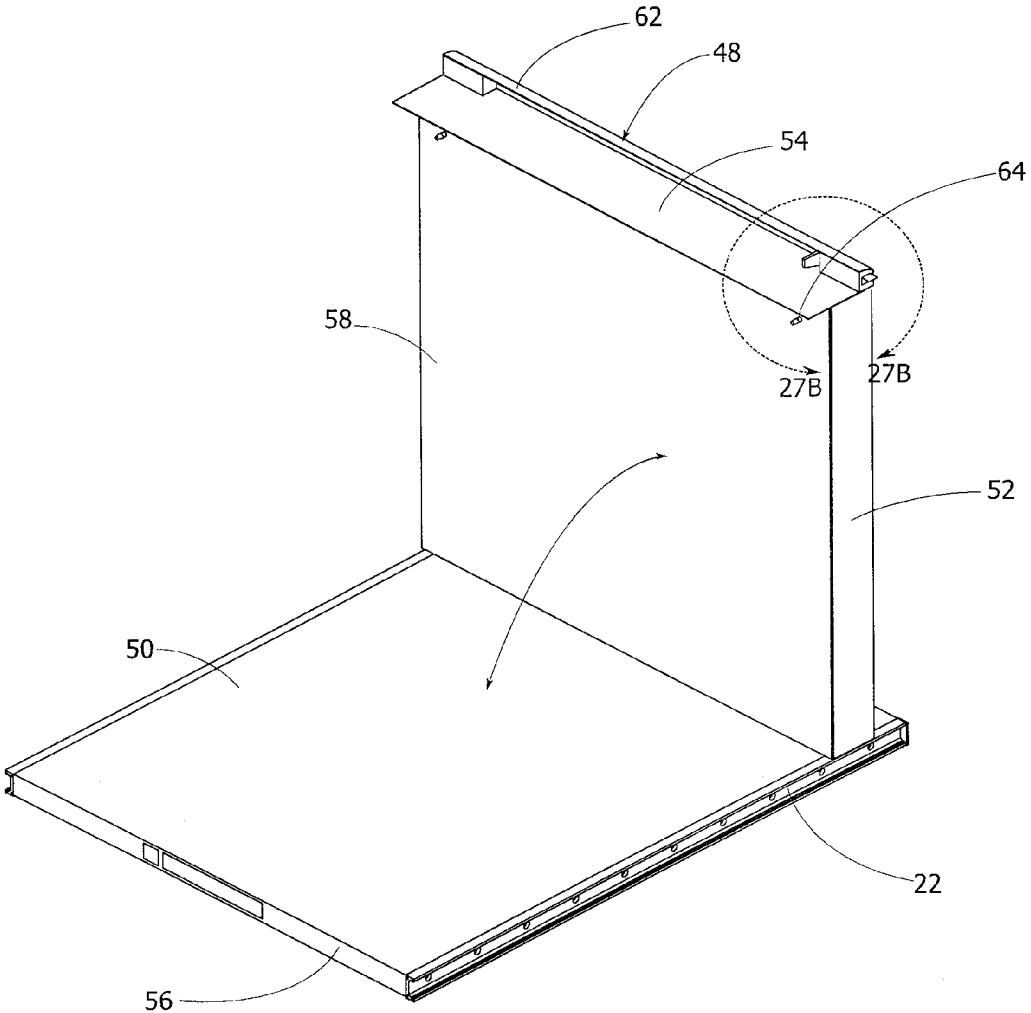
FIG. 27A is a deployed individual voting booth tray.
Figure 28:
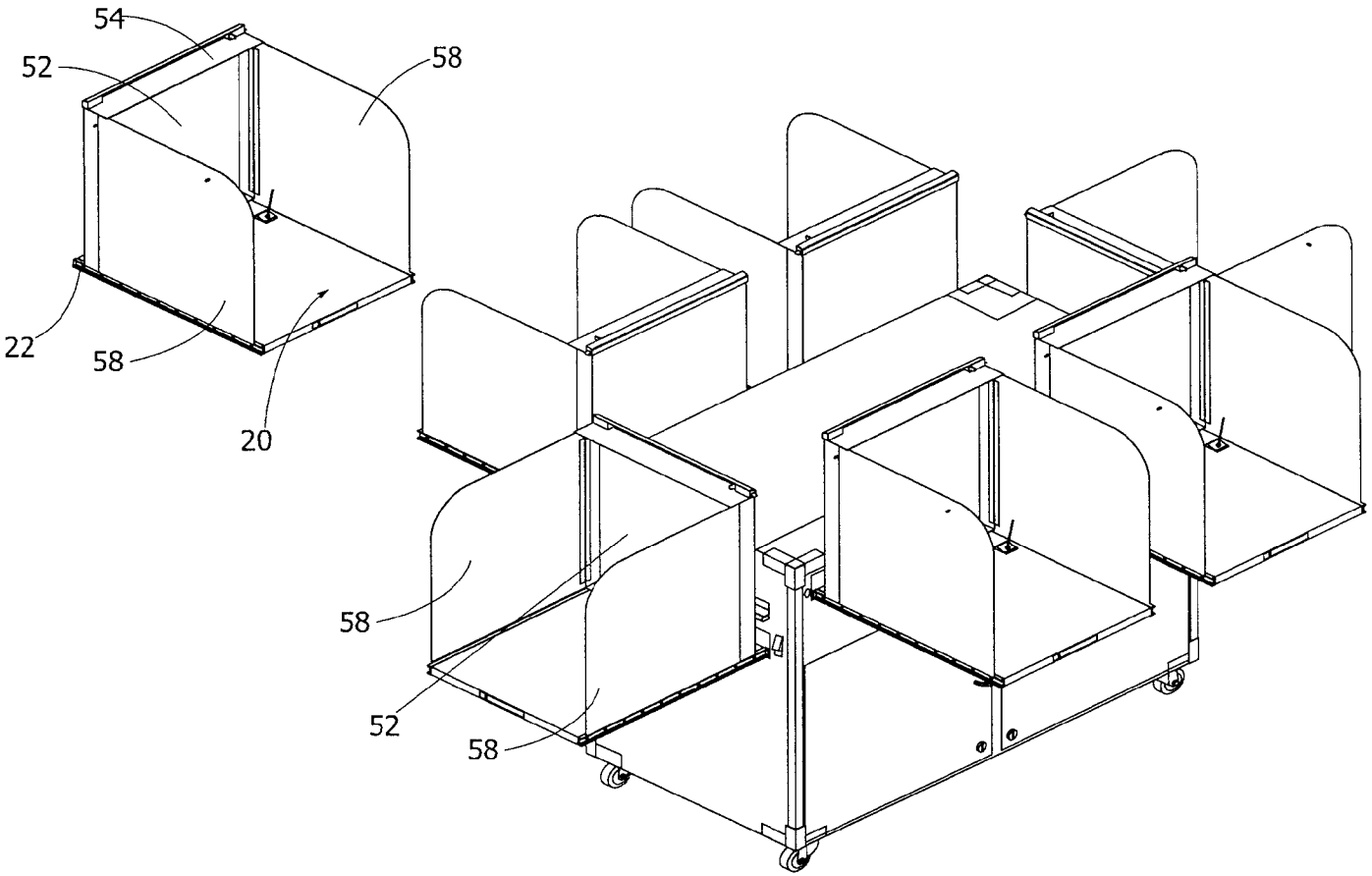
FIG. 28 is a perspective view of one embodiment of the present invention.

Referring to FIGS. 1, 2, 26A, 26B, 27A, 27B and 28, various embodiments of the voting tray 20 are illustrated. Each voting tray 20 may be provided with a mechanical lock 38 for securing the voting tray in a storage or deployed position. The trays may also be provided with an additional or alternative spring lock 40 that operates to prevent the trays from opening before they can be locked in position. The spring latch includes a spring loaded latch member 42 having a beveled edge 46 that cooperates with a catch aperture (not shown) as is known in the art. A release lever 44 is provided to allow easy release of individual voting trays 20. Each voting tray 20 is preferably provided with a carrel type privacy shield 48. The privacy shield is hingedly connected to the upper surface of the voting tray 20 so that it is movable between a storage position (FIG. 26A) and a deployed position (FIG. 28). The rear panel 52 of the privacy shield includes fascia 54 which covers the front surface 56 of the tray 20 while in a storage position. The fascia is provided with a hand grip 62 for pulling the tray outwardly from the voting cart 10. FIG. 27A illustrates pivoting the rear panel from the storage position to the deployed position wherein privacy shield side panels 58 may be pivoted about hinges 60 to their respective positions along the sides of tray 20 to provide privacy about three sides thereof Magnets, hook and loop, pins or the like may be used to retain the side panels of the privacy shield in a desired position. In at least one embodiment, the tray 20 is provided with lock pins 64 which may be mechanically or electronically connected to a central lock system 66. The central lock may be used to release and/or deploy all trays 20 at the same time. Servo motors, stepper motors, springs, solenoids or the like may be utilized to release the pins and move the trays to a deployed position or storage position. In this manner, a user may set up the voting cart very quickly and efficiently regardless of the persons size or mechanical abilities.

Figure 5:
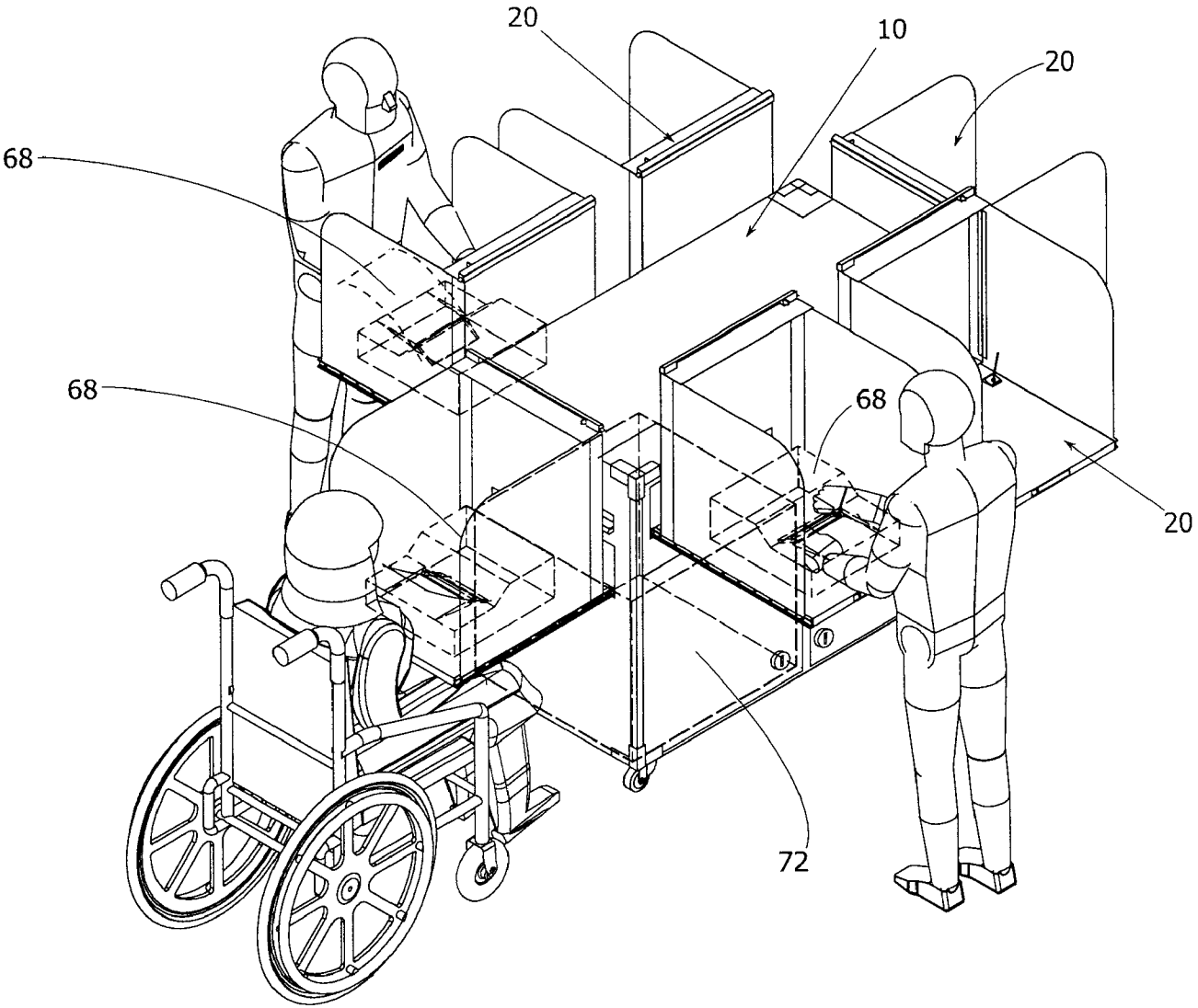
FIG. 5 is a perspective view of one embodiment of the present invention with the voting trays deployed.
Figure 6:
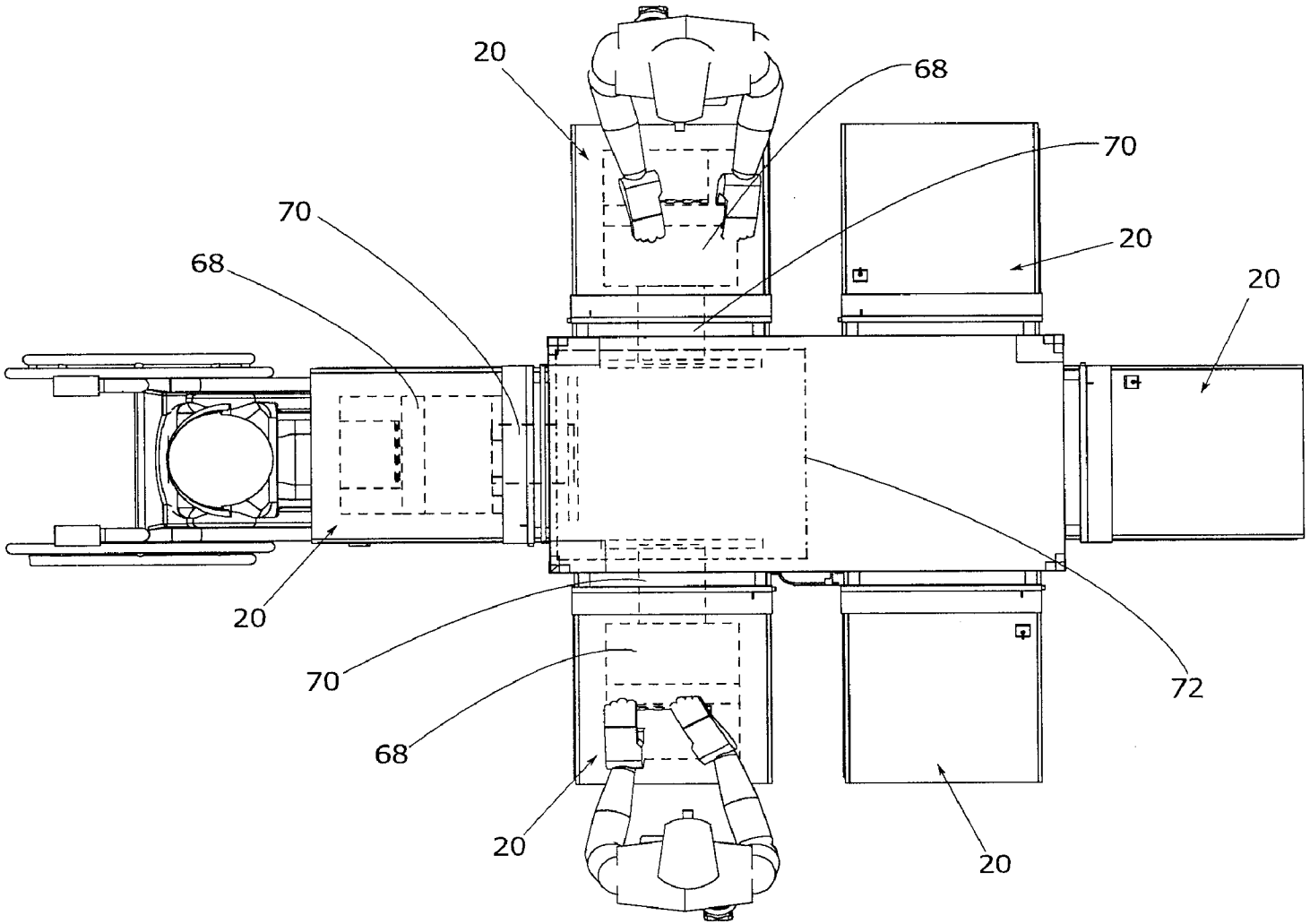
FIG. 6 is top view of the embodiment illustrated in FIG. 5.

Referring to FIGS. 3-6, one configuration of the voting cart 10 is illustrated. In this embodiment, six voting trays 20 are deployed. One tray 20 at each side of the cart is positioned at a lower height for use by a handicapped individual while the remaining trays are positioned at a height for non-handicapped individuals. In this configuration, three of the trays are illustrated with users filling out the voting ballot (FIGS. 3 and 4) while the remaining trays are utilized for holding a scanning machine 68 for each person filling out a ballot. FIGS. 5 and 6 illustrate the voters inserting their ballots in a respective scanner machine 68 for counting after being filled out. The scanners may include a chute 70 that is constructed and arranged to direct the scanned ballot to a ballot box 72 positioned within the voter cart 10.

Figure 9:
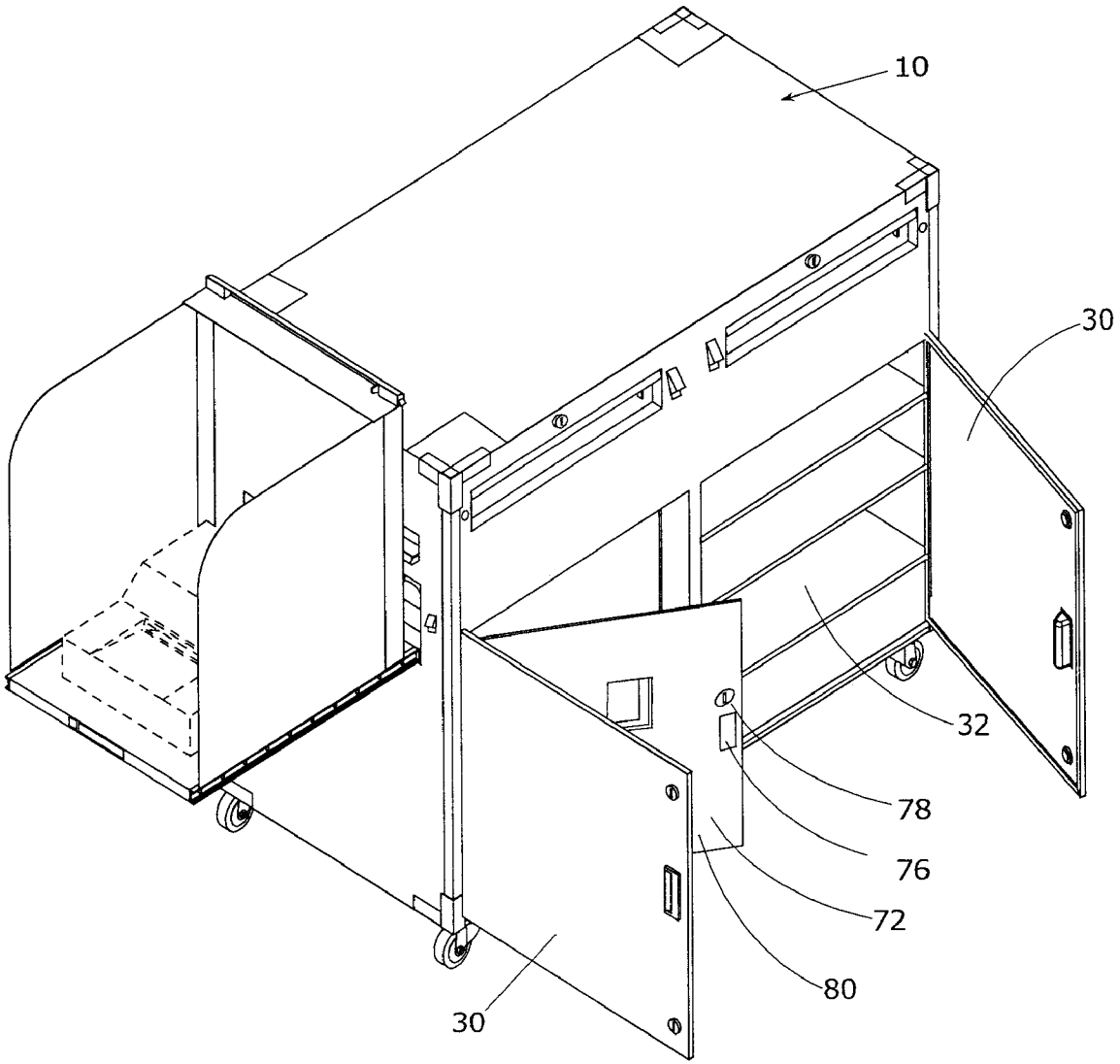
FIG. 9 is a front perspective view of one embodiment of the present invention.
Figure 11:
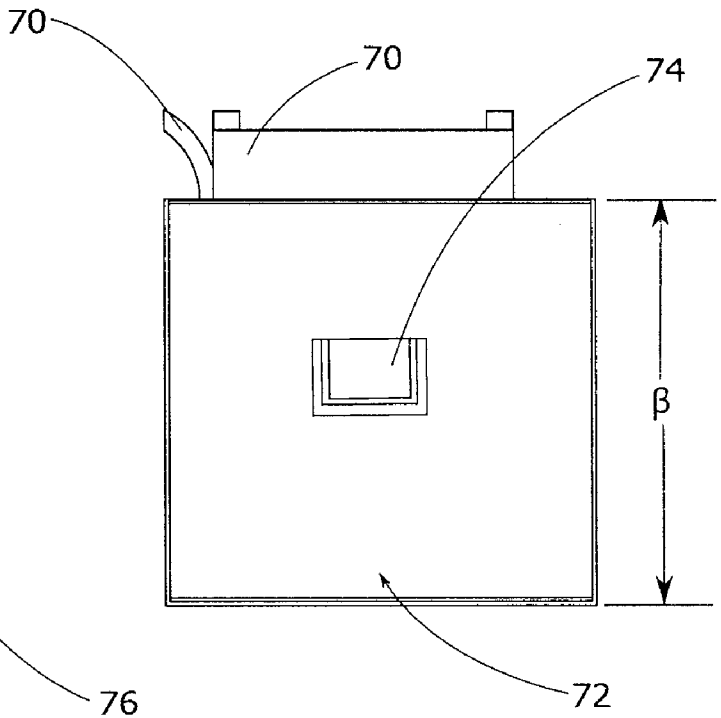
FIG. 11 is a front view of one embodiment of a ballot box.
Figure 10:
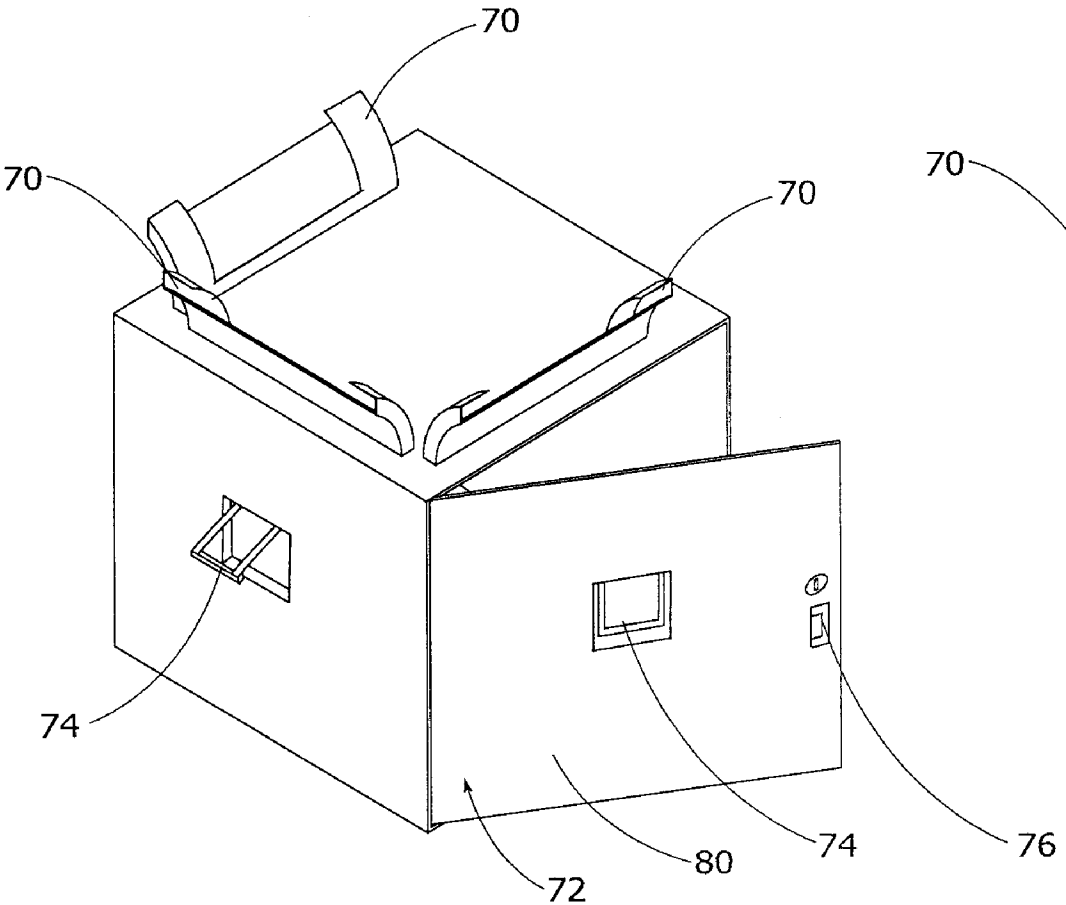
FIG. 10 is a front perspective view of one embodiment of a ballot box.
Figure 13:
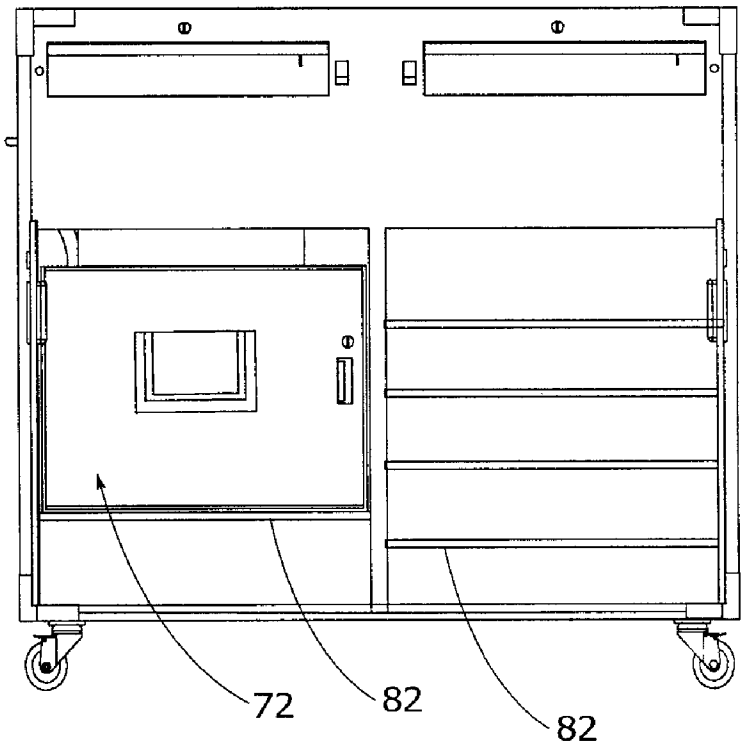
FIG. 13 is a front view of one embodiment of the present invention with the doors open.
Figure 12:
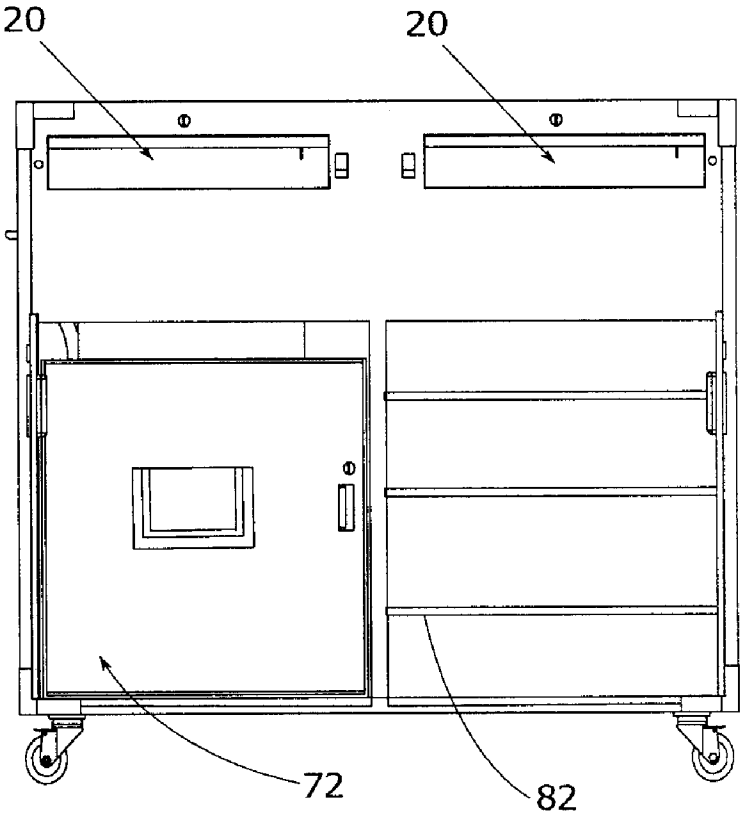
FIG. 12 is a front view of one embodiment of the present invention illustrating the doors in an open position.

Referring to FIGS. 7-13, various embodiments of the ballot box 72 are illustrated. In particular, the storage access doors 30 are open to illustrate the ballot box 72 is located in a secure location within the voting cart 10. A handle 74, a latch 76 and a lock 78 are provided on the ballot box for gaining access to the interior of the ballot box and for securing the contents of the ballot box to prevent tampering with or theft of the ballots. The optical scanner 68, illustrated in phantom, on the voting booth tray is stored adjacent the ballot box 72 within the cart when the scanner is not in use. In a most preferred embodiment, the ballot box is secured along a sliding track system 22 similar to those used for the trays 20 to allow the ballot box to be pulled inwardly and outwardly from the voting cart 10. FIGS. 9 and 10 illustrate the door 80 of the ballot box 72 in an open position for servicing the ballot box or to collect the marked ballot papers. FIG. 10 shows the ballot box removed from the voting cart 10 with pull out handles 74 for lifting the ballot box 72. The ballot box is preferably provided with at least one, and more preferably three, paper ballot inlet chutes 70 which guide the marked paper ballots from the optical scanners 68 into the ballot box 72. FIG. 11 illustrates that the ballot box 72 could be manufactured with various heights β dependent on the customer requirements. The custom built-in ballot box is customizable to receive 8/7/6/5/4/3/2/1 inlets for ballot paper receiving. FIGS. 12 and 13 illustrate different configurations of ballot box/shelf arrangements achieved using vertically adjustable shelves 82. The underside of the ballot box is configured to have additional storage areas. The shelves 82 are adjustable to accommodate scanners, optical scan machines, non-optical scan machines, touch screen voting machines, paper ballots, voting stationeries and accessories stored within the cart. In this manner, the internal storage area may be custom configured for each individual voting operation or cycle.

Figure 14:
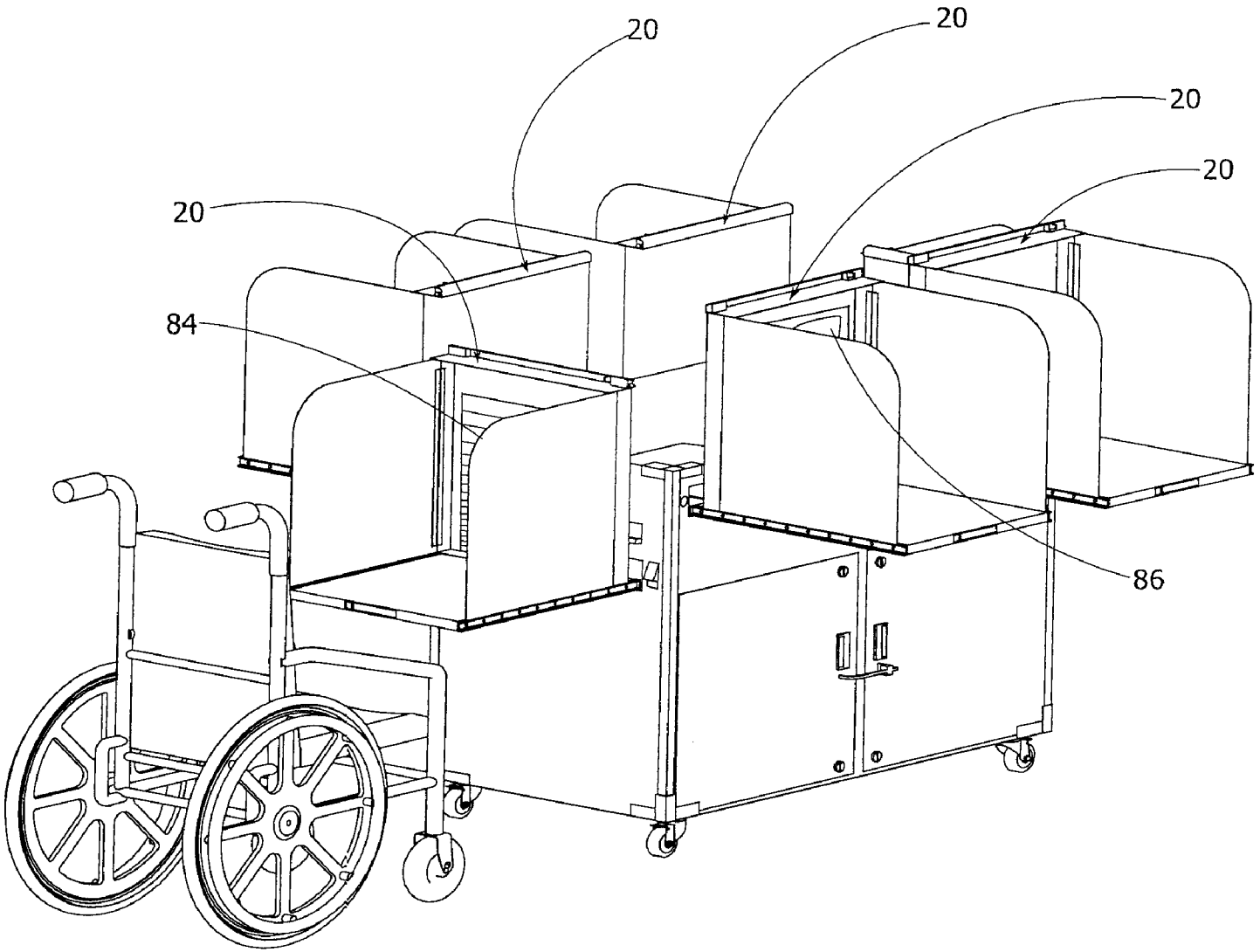
FIG. 14 is a perspective view of one embodiment of the present invention with the voting booths deployed similar to FIG. 5.

FIG. 14 is a front perspective view of the voting cart of the present invention with the voting trays 20 illustrated in a deployed position. A set of instructions 84 are displayed on the back panel of each voting tray 20 along rear privacy panel shield 52. In most instances the instructions are printed on paper for display. Alternatively, an electronic screen 86 such as an LCD screen can be provided to include the voting instructions and any other information. By utilization of the electronic screen, different instructions can be displayed. Different languages can be displayed, and graphics utilized in place of, or in conjunction with, words can be displayed.

Figure 15:
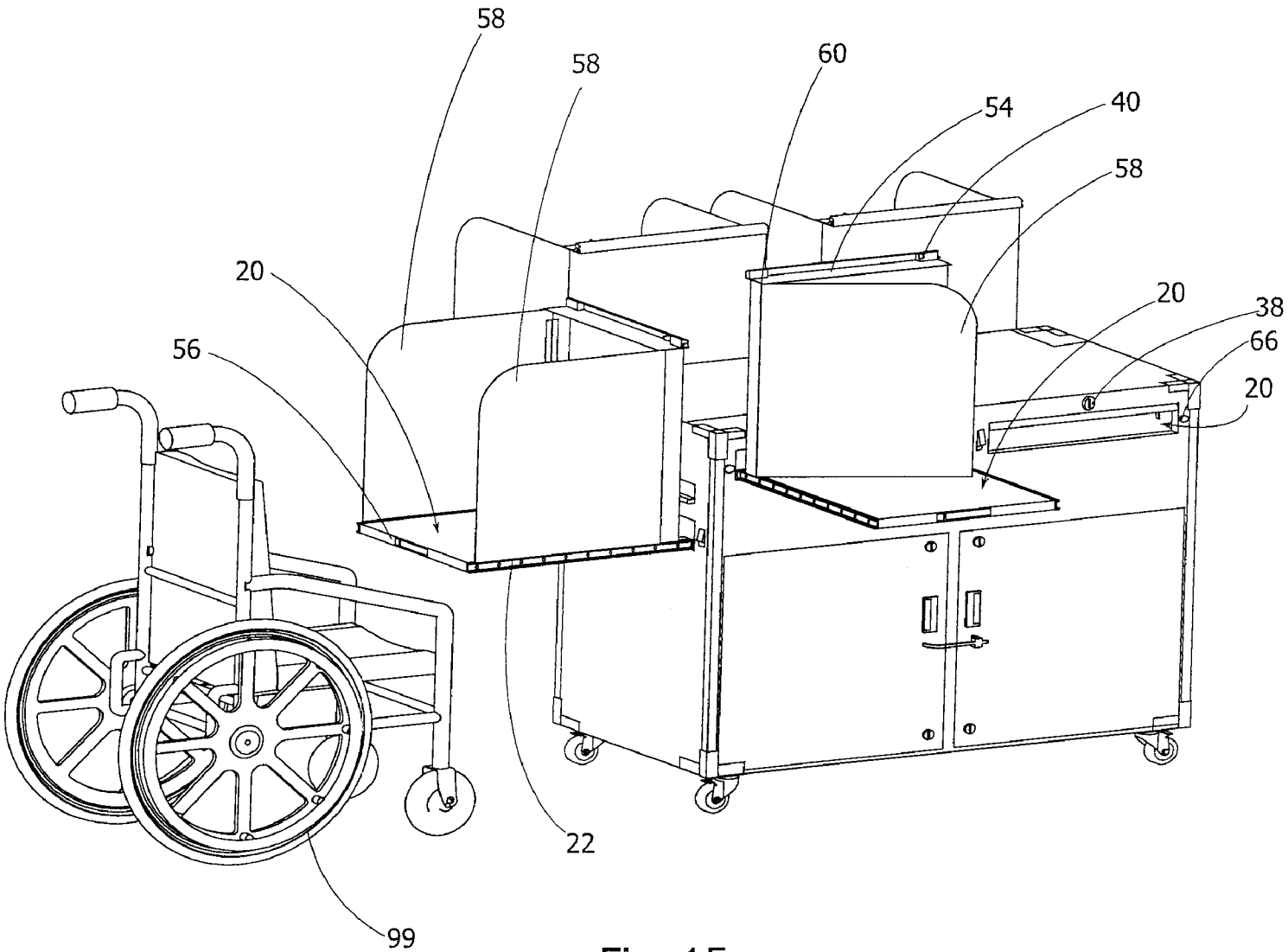
FIG. 15 is a perspective view of the embodiment illustrated in FIG. 8 with one voting booth stored away.

FIG. 15 is a perspective view of the voting cart 10 illustrated as having trays in various stages of deployment. One tray is illustrated in a storage position while another tray is illustrated as having the privacy shield in a partially deployed position wherein voting booth tray 20 is shown in an extending position with the privacy shield in an upright but closed position. As will be noted by the placement of the wheelchair 99, side voting tray 20 is placed at a position lower than the standing position of the voting trays positioned at the front and rear of the voting cart 10. The front fascia 54 of the tray 20 further serves as a top cover and allows placement of an active light 87 (FIG. 16) for use in areas wherein the documents require illumination. The active light may utilize motion detectors, timers or the like for controlling the usage of electricity.

Figure 16:
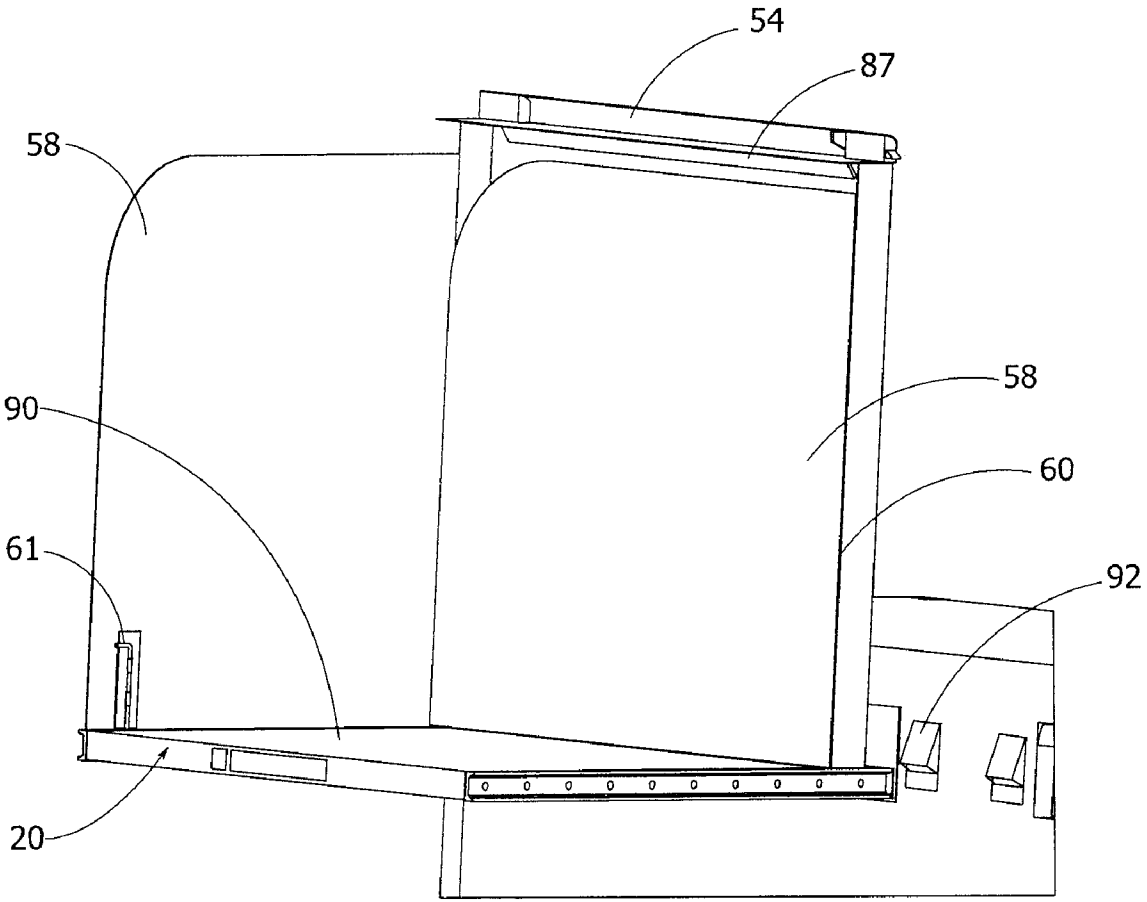
FIG. 16 is a perspective view of one embodiment of an individual voting booth.

Referring to FIG. 16, a perspective view of the voting tray 20 is illustrated. The voting tray 20 includes a working surface 90 with one carrel side panel 58 in a deployed position while the other carrel side panel 58 is illustrated in a storage position. From this view, the hinge 60 can be clearly seen, allowing the side panel 58 to rotate from the storage position to a deployed position which would be parallel to the left side panel 58. As noted, the side panels 58 include a locking mechanism for maintaining the side panels 58 in a deployed position. The locking mechanism in this embodiment is a spring loaded pin 61 that can be raised to allow movement, and upon release is biased in a downward position so as to engage an aperture in the surface 90 of the tray 20. Another mechanism that can maintain the panels in position can be the use of magnets, not shown, which are preferable if the surface 90 is made of a material that may lead to marring so as to prevent etching of the surface by improper opening and closing of the side panels. Fascia 54 can be seen with light 87 directly beneath the fascia for ease of illumination. A time adjustable, brightness adjustable and rotatable motion sensor LED light is preferably employed to illuminate each voting tray. An on/off switch 92 can be utilized to control the LED light.

Figure 17:
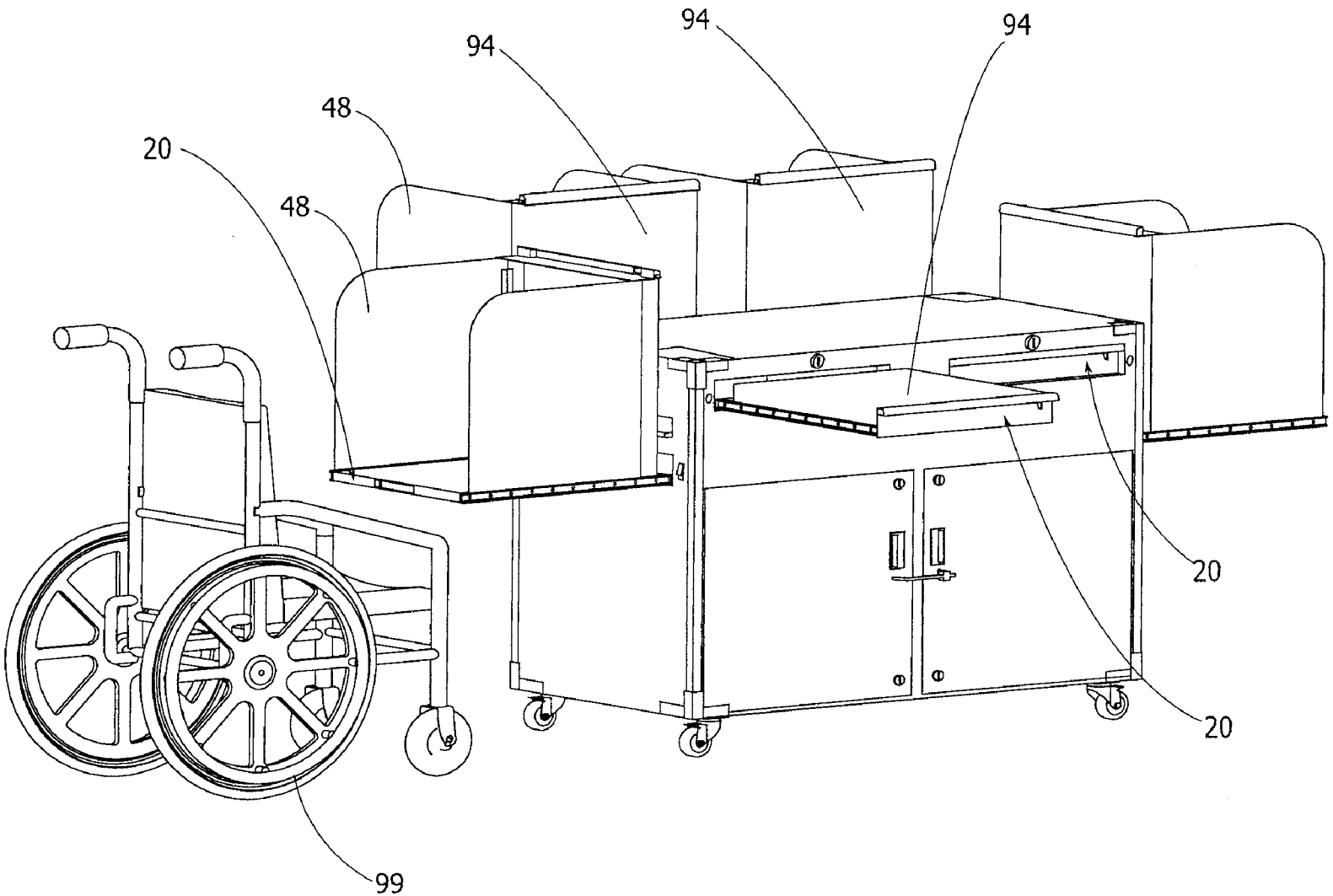
FIG. 17 is a perspective view of one embodiment of the present invention with one voting booth stowed away and one voting booth in a collapsed position.

FIG. 17 further illustrates versatility wherein tray 20 is deployed to allow a working surface 94 on a rear surface of a rear panel privacy shield 52 of tray 20. The trays 20 positioned at the sides of the voting cart 10 are shown in deployment at a position for ease of access by a wheelchair 99 bound individual. The trays 20 positioned at the rear of the voting cart 10 are shown in a deployed position allowing voting along the back of the booth. The front right tray 20 is shown in the closed position.

Figure 19:
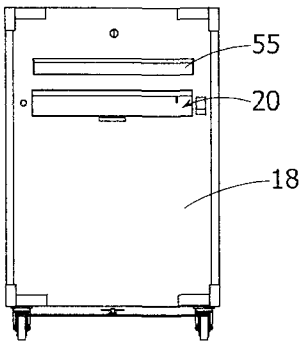
FIG. 19 is a left side view of one embodiment of the present invention.
Figure 18:
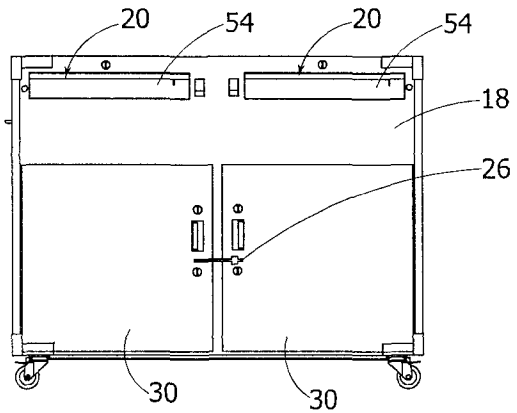
FIG. 18 is a front view of one embodiment of the present invention.
Figure 20:
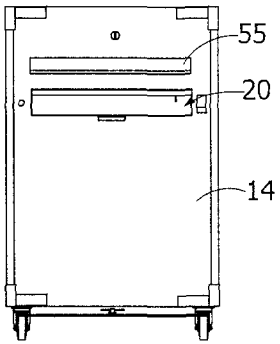
FIG. 20 is a right side view of one embodiment of the present invention.
Figure 21:
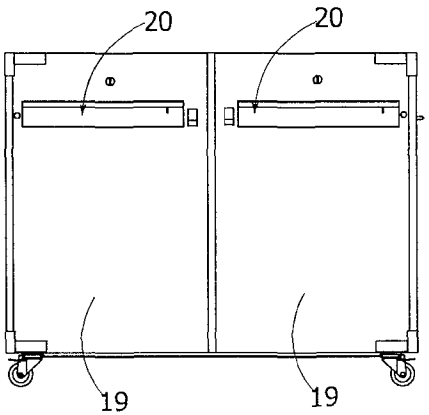
FIG. 21 is a rear view of one embodiment of the present invention.

Referring to FIGS. 18-21, plan views of the embodiment illustrated in FIGS. 1-2 are illustrated. FIG. 18 is a front view of one alternative embodiment of the cart of the present invention. The cart has left and right doors 30 for access to the interior storage area of the voting cart 10. They are secured together with a security seal 26. A front panel 18 includes two voting booth trays 20. The trays include front fascia 54. FIG. 19 is a left side view setting forth a voting cart 10 with a handle 55 for movement of the cart as necessary. FIG. 20 has side panel 14 with voting tray 20 and handle 55 for movement of the cart. FIG. 21 depicts a rear view of the cart. Rear panels 19 are shown with a left and right tray 20 available for use as needed.

Figure 22:
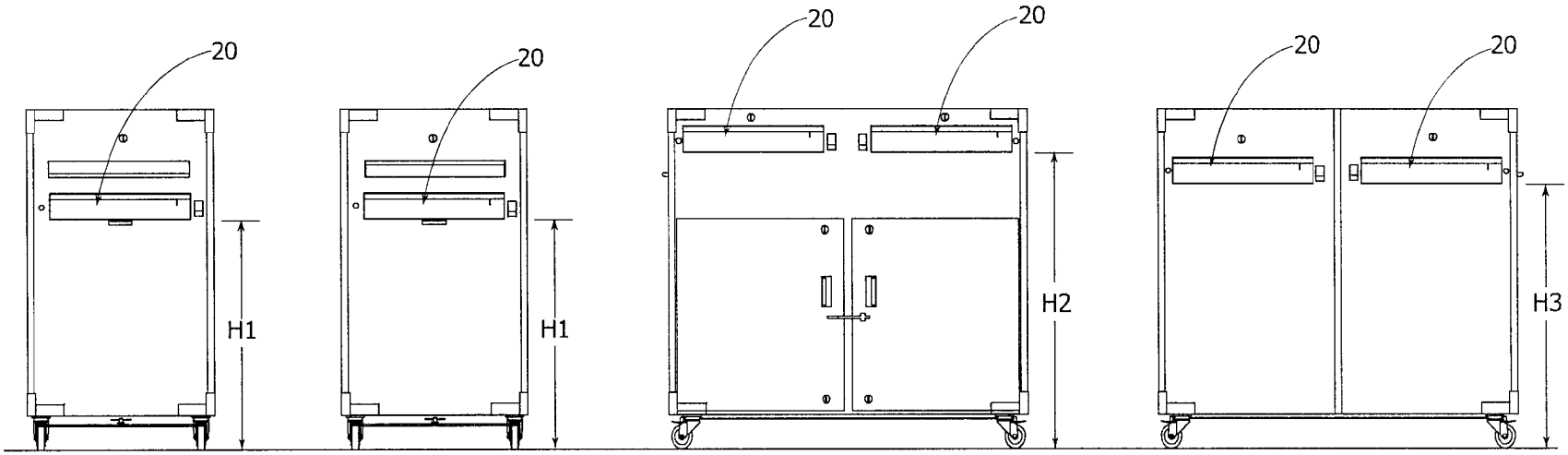
FIG. 22 is an alternative embodiment of one embodiment of the present invention.

FIG. 22 illustrates another embodiment of the present invention. For proper wheelchair access, the trays 20 positioned at the sides of the voting cart are placed at an ADA compliant height (H1) above the floor, allowing ease of movement for a standard wheelchair with the clearance beneath the trays. A front right tray 20 is placed a distance of (H2) above the floor, and a rear tray 20 is placed (H3) above the surface of the floor. The result is the use of two lower trays that allow wheelchair accessibility, a middle tray 20 placed along the middle level, and a tray 20 located at the highest level. It should also be noted that the stacking of the trays allows for compactness of the utility cart, allowing the trays to be retracted into a position allowing clearance of each tray in a recessed position. While these dimensions are preferred, any other dimensions can also be employed without departing from the scope of the invention.

Referring to FIG. 23, a bottom perspective view is illustrated showing a central braking system. A central brake includes a pedal 36 connected by linkage 320 to all the wheels 34. In this manner, an operator can depress brake pedal 36 from either side of the voting cart 10 to engage the brake on all wheels simultaneously. It should also be noted that cables or solenoids may be utilized in place of the linkage without departing from the scope of the invention.

Figure 24:
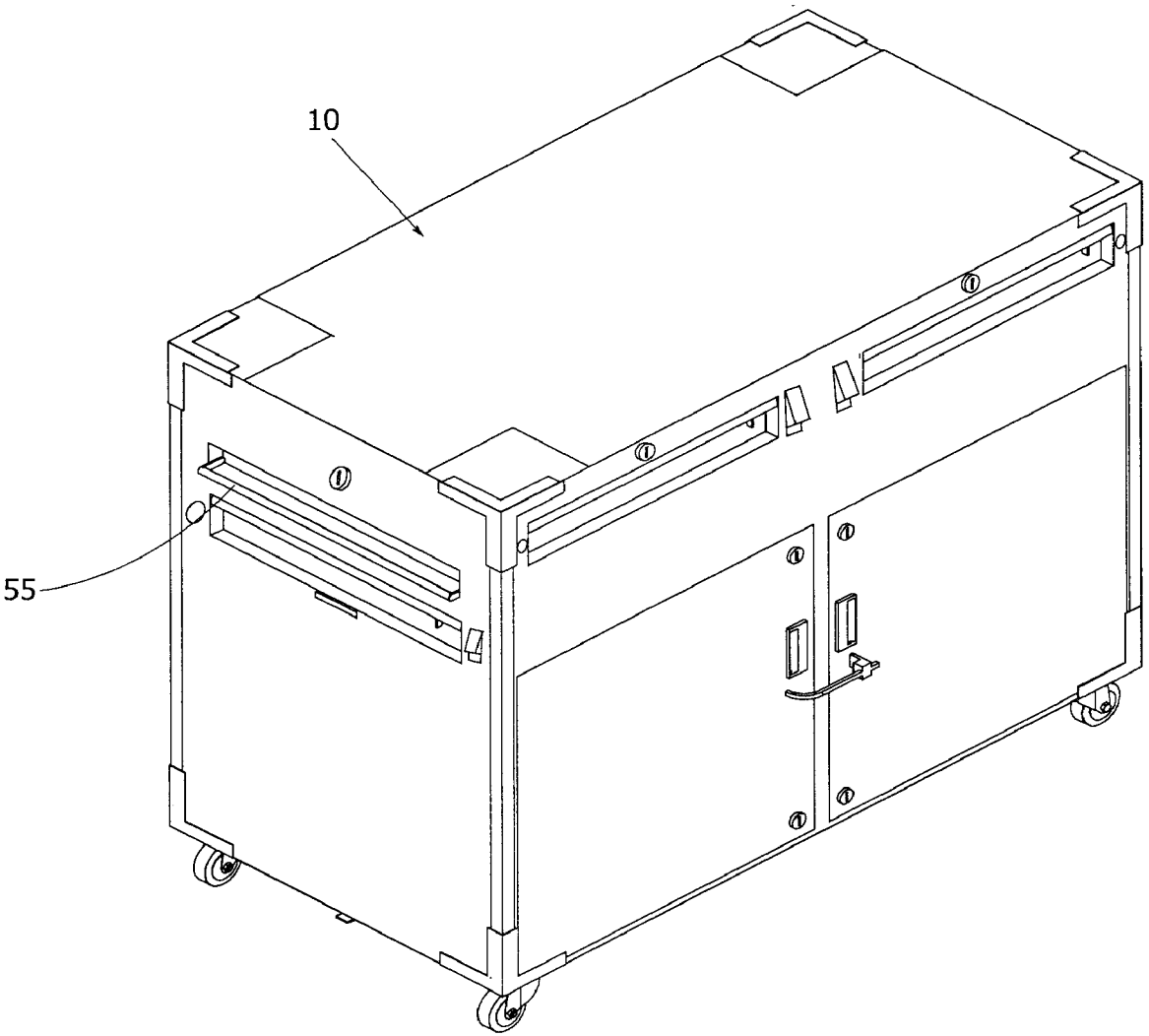
FIG. 24 is a front perspective view of one embodiment of the present invention.
Figure 25:
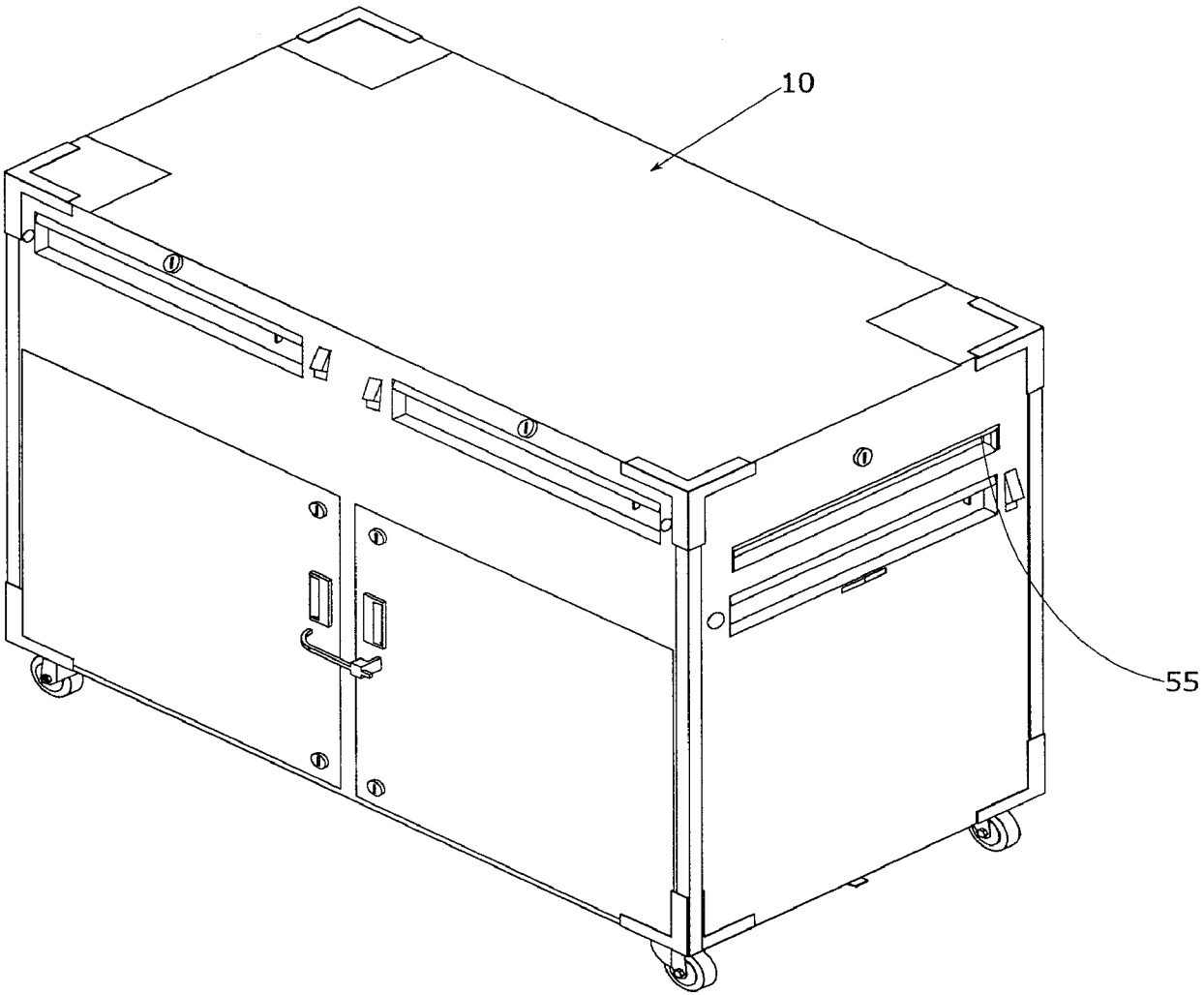
FIG. 25 is a front perspective view of one embodiment of the present invention.
Figures 26A, 26B:
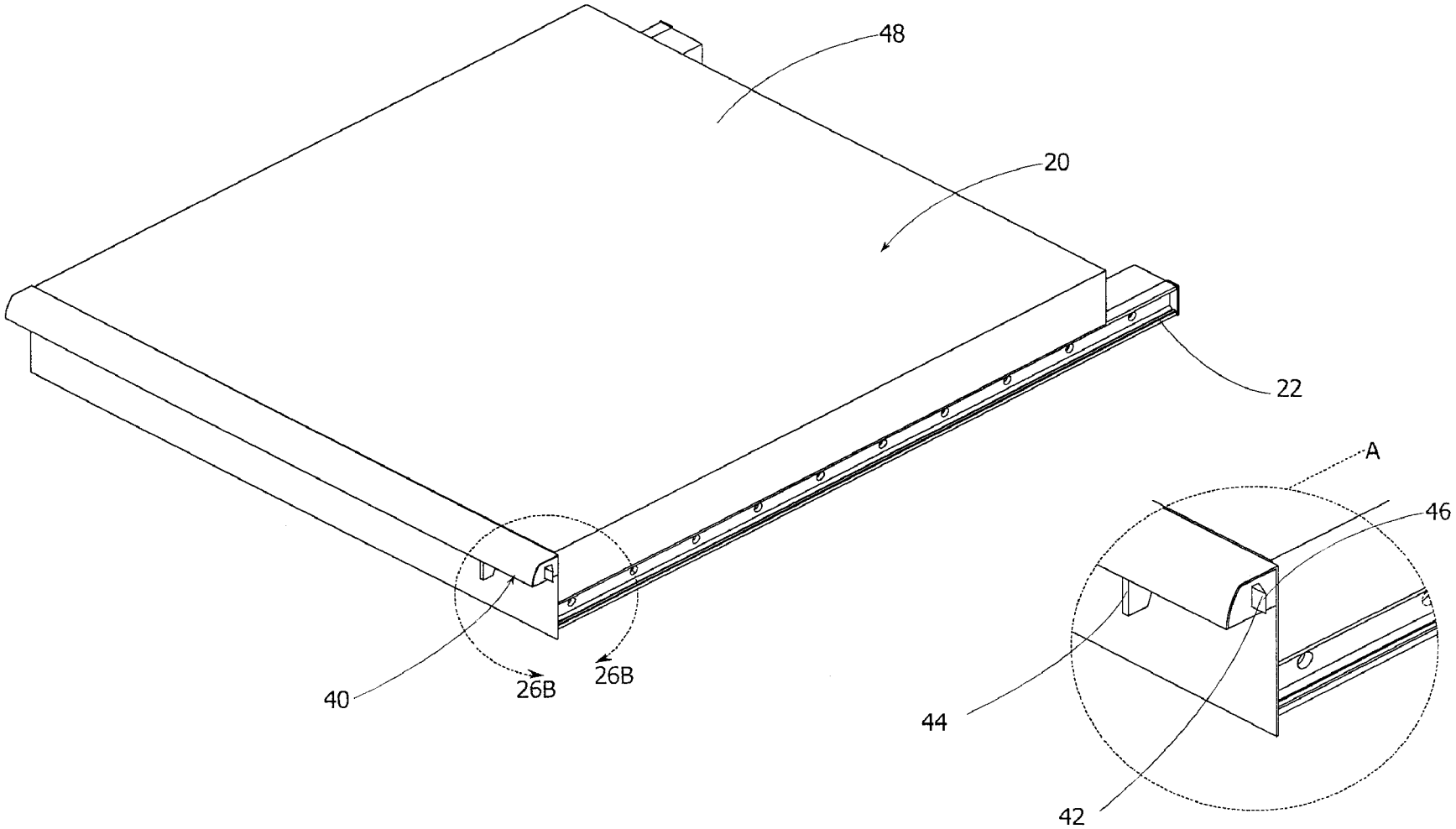
FIG. 26A is a collapsed individual voting booth tray.
FIG. 26B is an enlarged portion of FIG. 26A.

Referring to FIGS. 24-25 a top perspective view of one embodiment of the voting cart is illustrated. In this embodiment, a pop out handle 55 which is used to move the cart is shown. In a deployed position, the handle is used to push, pull and turn the cart. FIG. 25 shows handle 55 in its stowed away position when it is not in use. The stowed or storage position allows voting carts 10 to be stacked in a tighter configuration for storage or transport while providing increased safety to those walking around the cart.

Figure 29:
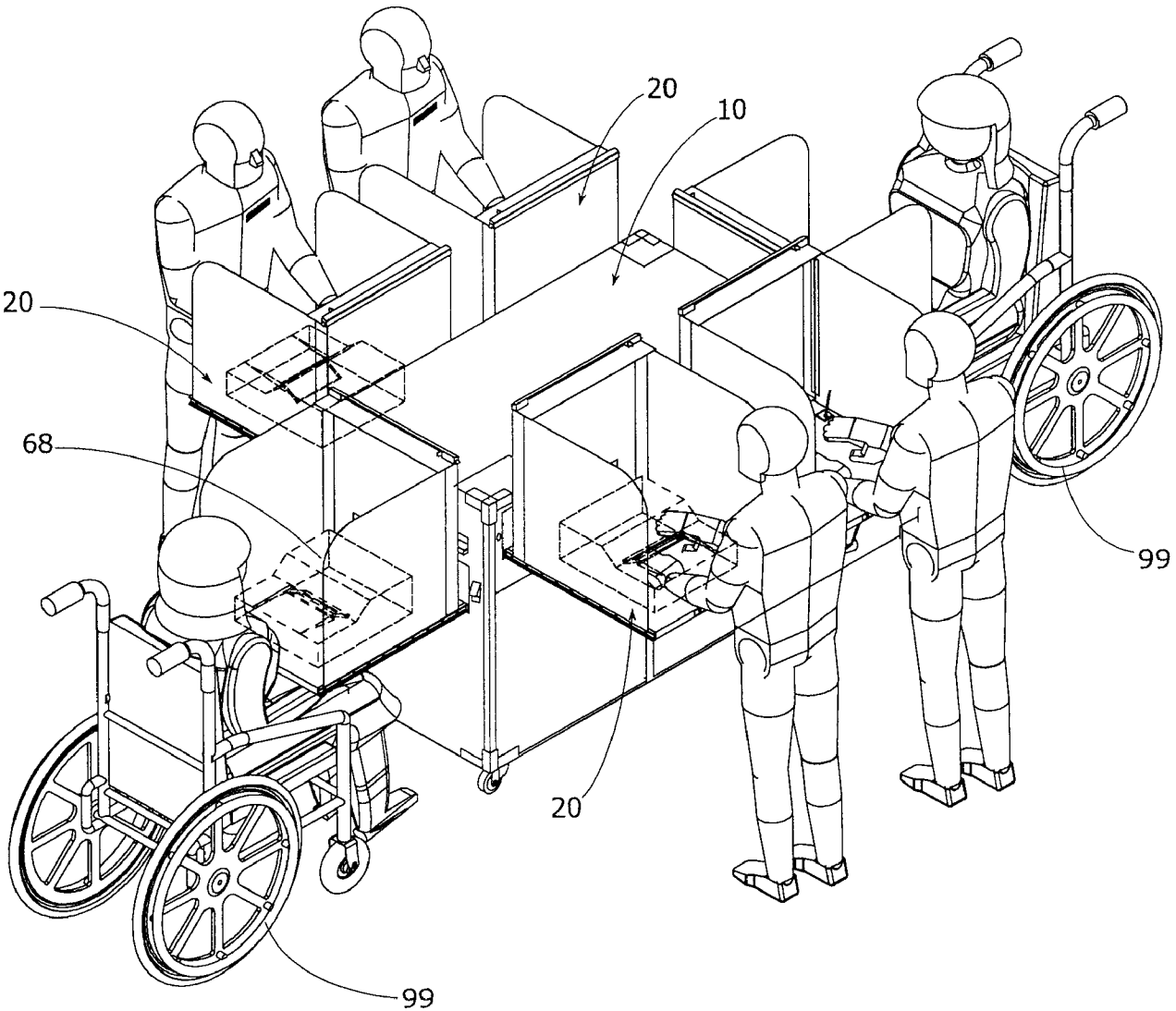
FIG. 29 is a perspective view of the present invention with individuals using the invention.

FIG. 29 illustrates an embodiment of the present invention having a configuration of the voting cart 10 of the present invention with three (3) voting trays 20 for marking ballots and three (3) voting trays 20 utilized for optical ballot paper scanning counters.

Figure 30:
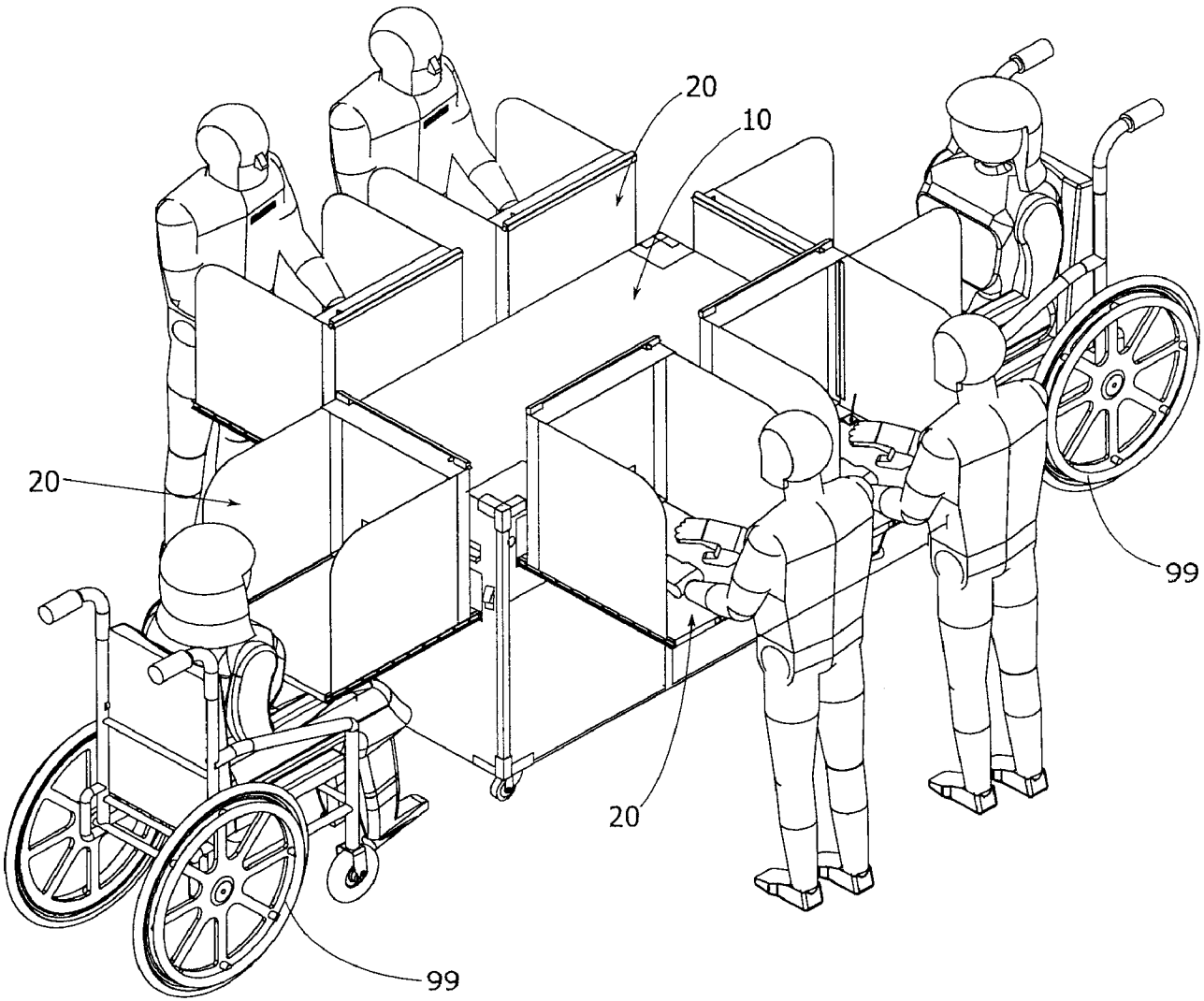
FIG. 30 is a front view of one embodiment of the present invention.
Figure 31:
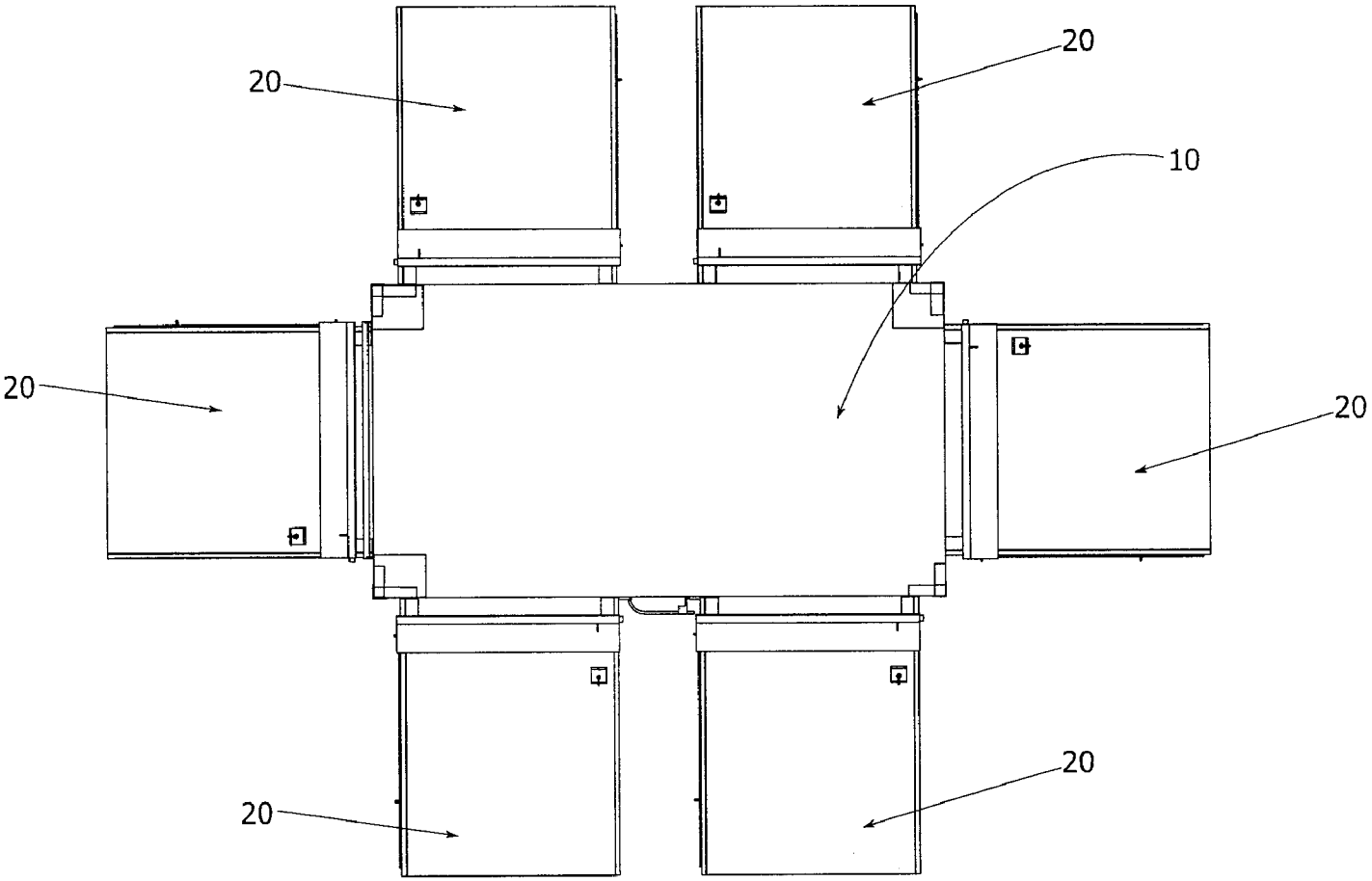
FIG. 31 is a top view of one embodiment of a six station voting cart device.

FIGS. 30 and 31 illustrate an embodiment of the present invention having a configuration of six (6) voting trays 20.

Figure 32:
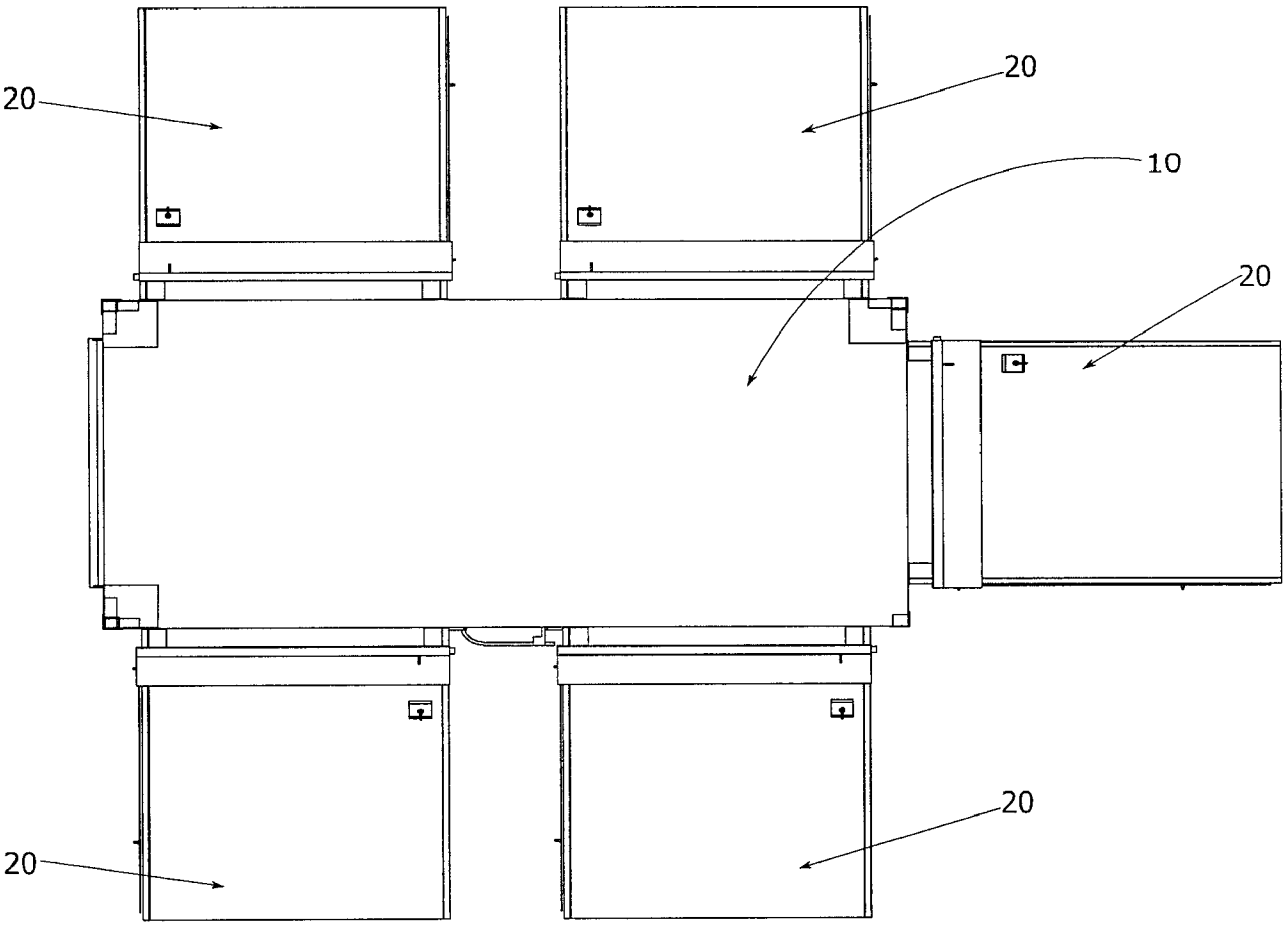
FIG. 32 is a top view of one embodiment of a five station voting cart device.

FIG. 32 illustrates an embodiment of the present invention having a voting cart 10 with five (5) voting trays 20.

Figure 33:
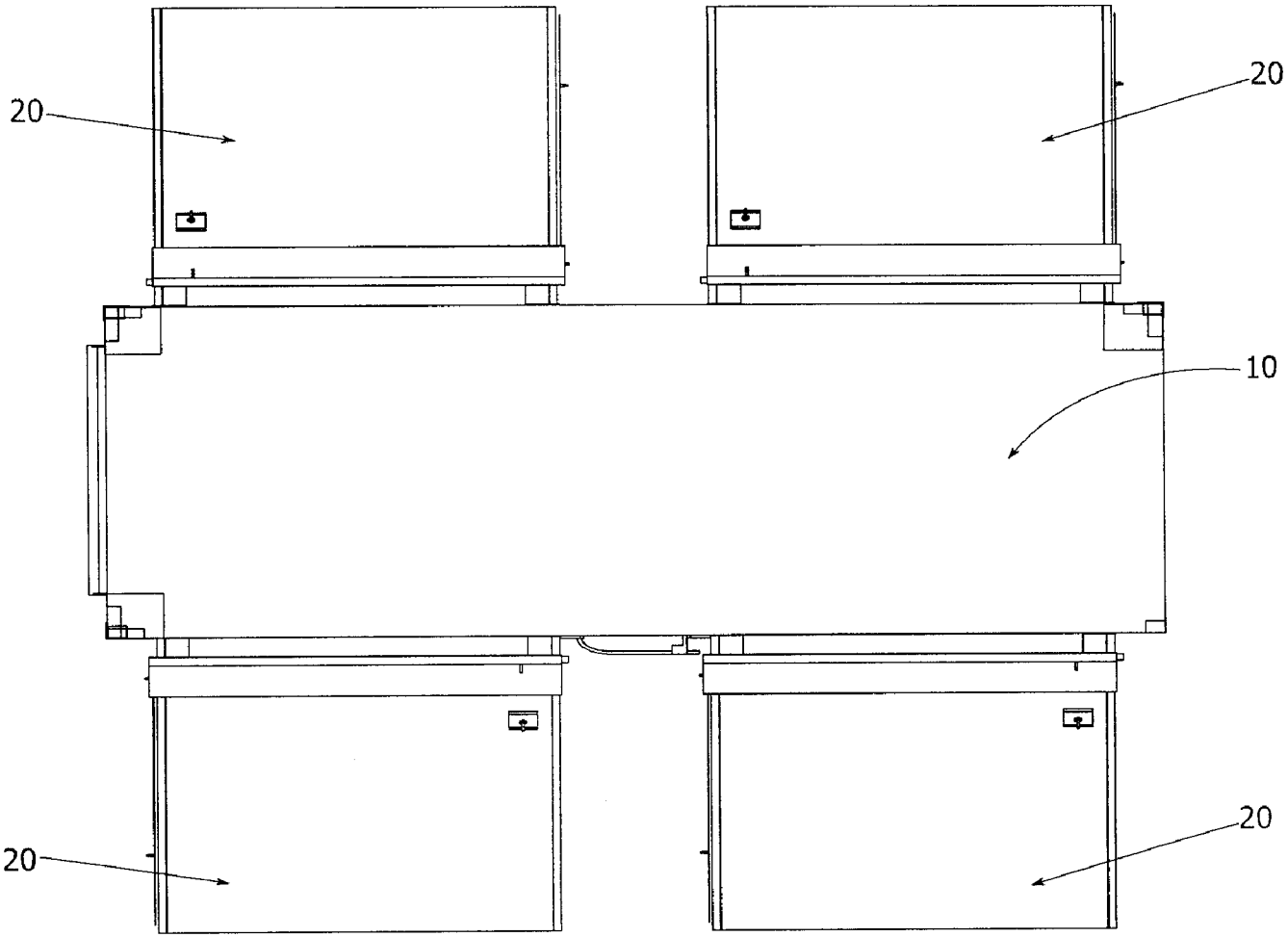
FIG. 33 is a top view of one embodiment of a four station voting cart device.

FIG. 33 illustrates an embodiment of the present invention having a cart 10 with four (4) voting trays; the trays of this embodiment being wider than those shown in prior embodiments.

Figure 34:
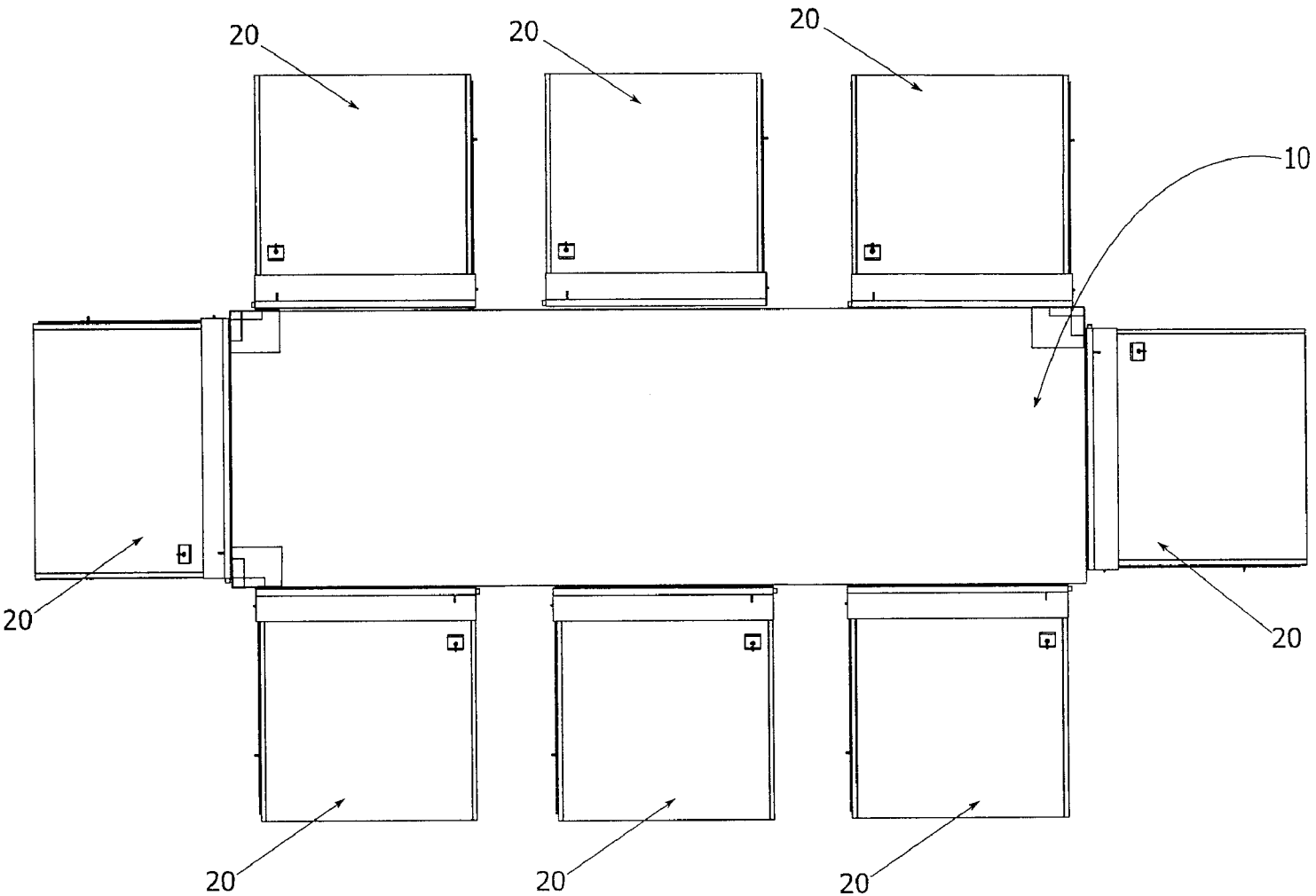
FIG. 34 is a top view of one embodiment of an eight station voting cart device.

FIG. 34 illustrates an embodiment of the present invention having a cart 10 with eight (8) voting trays 20.

Figure 35:
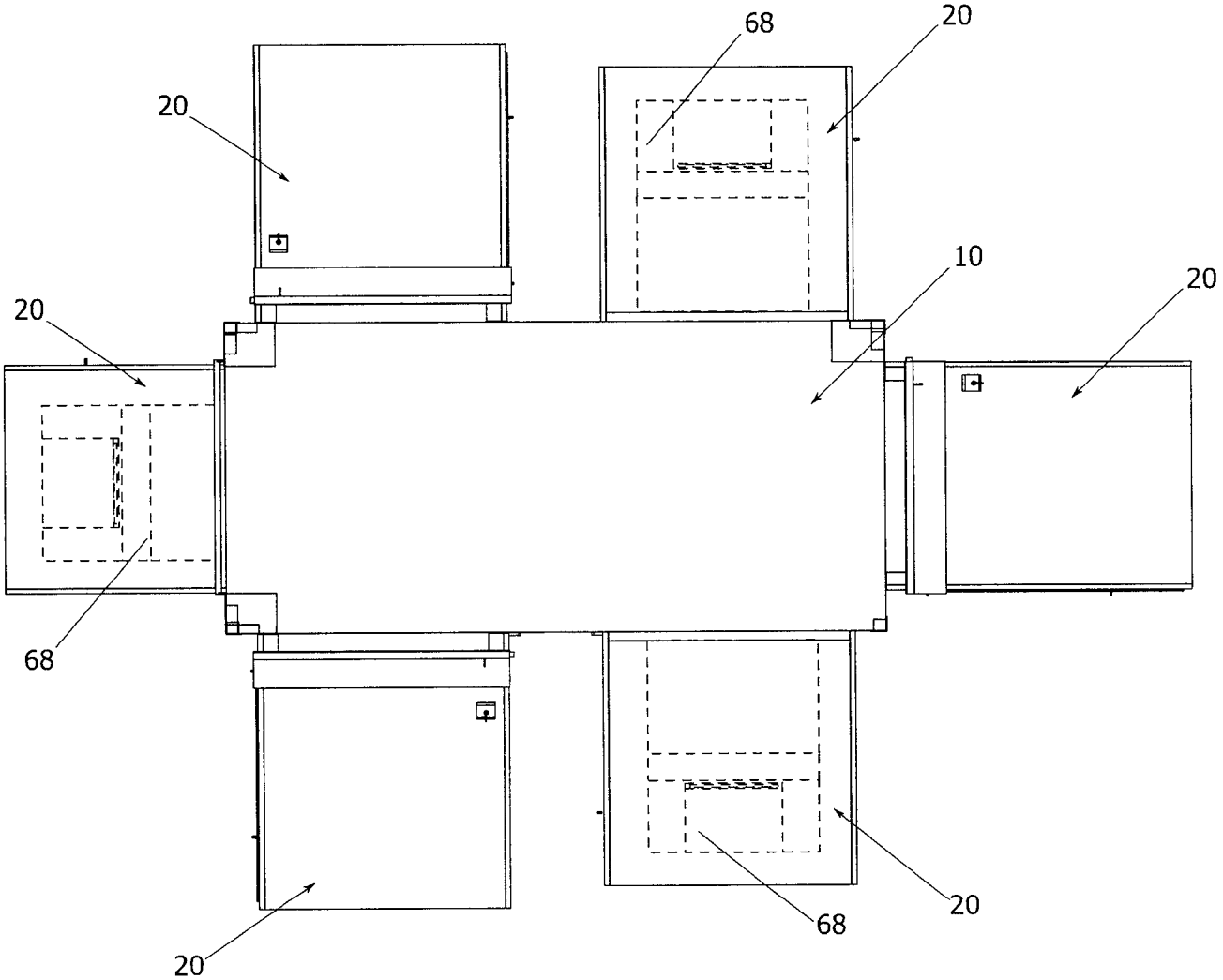
FIG. 35 is a top view of one embodiment of a six station voting cart device.

FIG. 35 illustrates an embodiment of the present invention having a cart 10 with three (3) voting trays 20 arranged for use in filling out voting ballots and three (3) voting trays 20 being utilized for holding optical paper ballot scanning.

Figure 36:
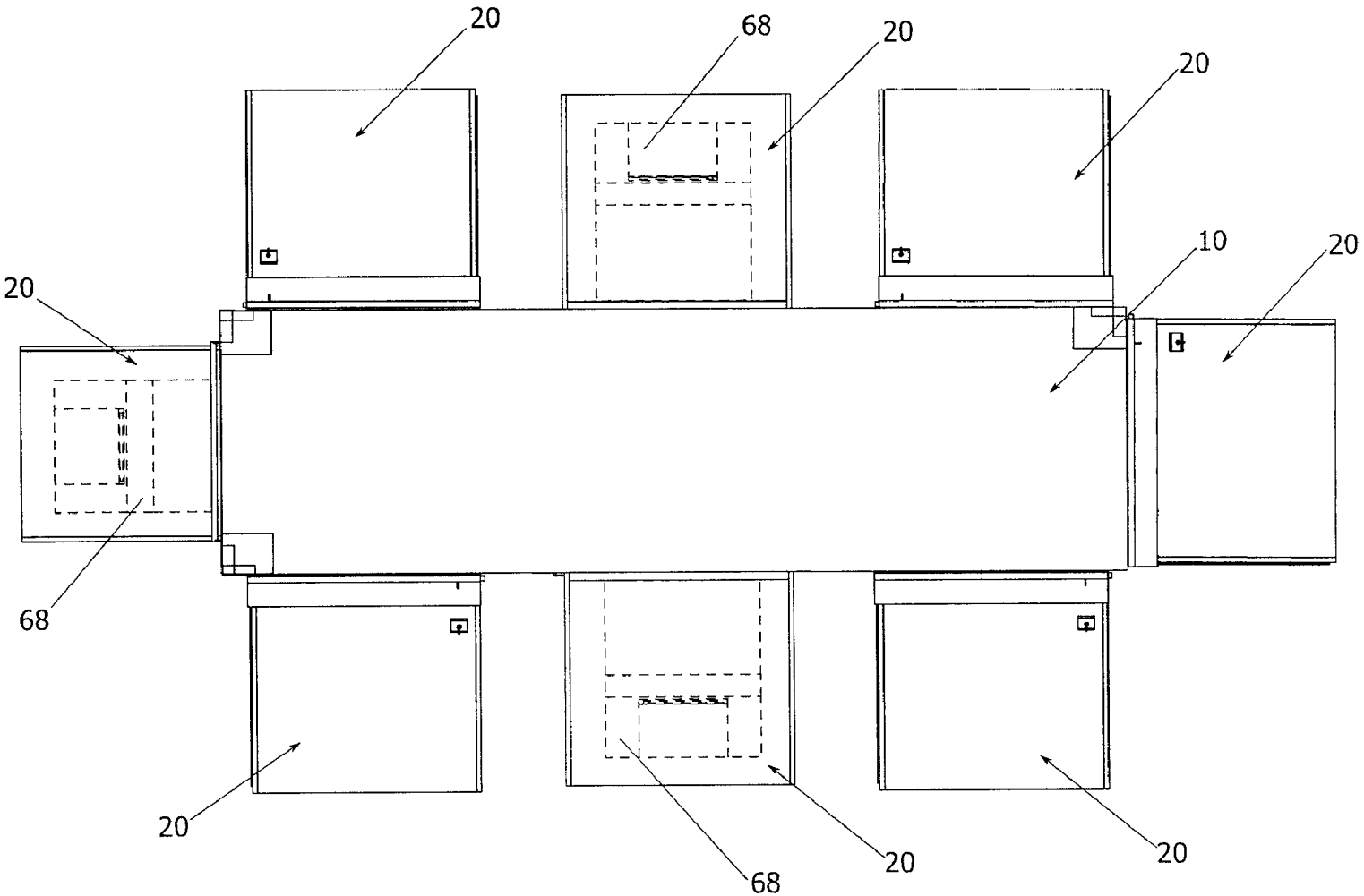
FIG. 36 is a top view of one embodiment of an eight station voting cart device.

FIG. 36 illustrates an embodiment of the present invention having a cart 10 with five (5) voting trays 20 and three (3) voting trays being utilized for optical paper ballot scanning devices.

Figure 37:
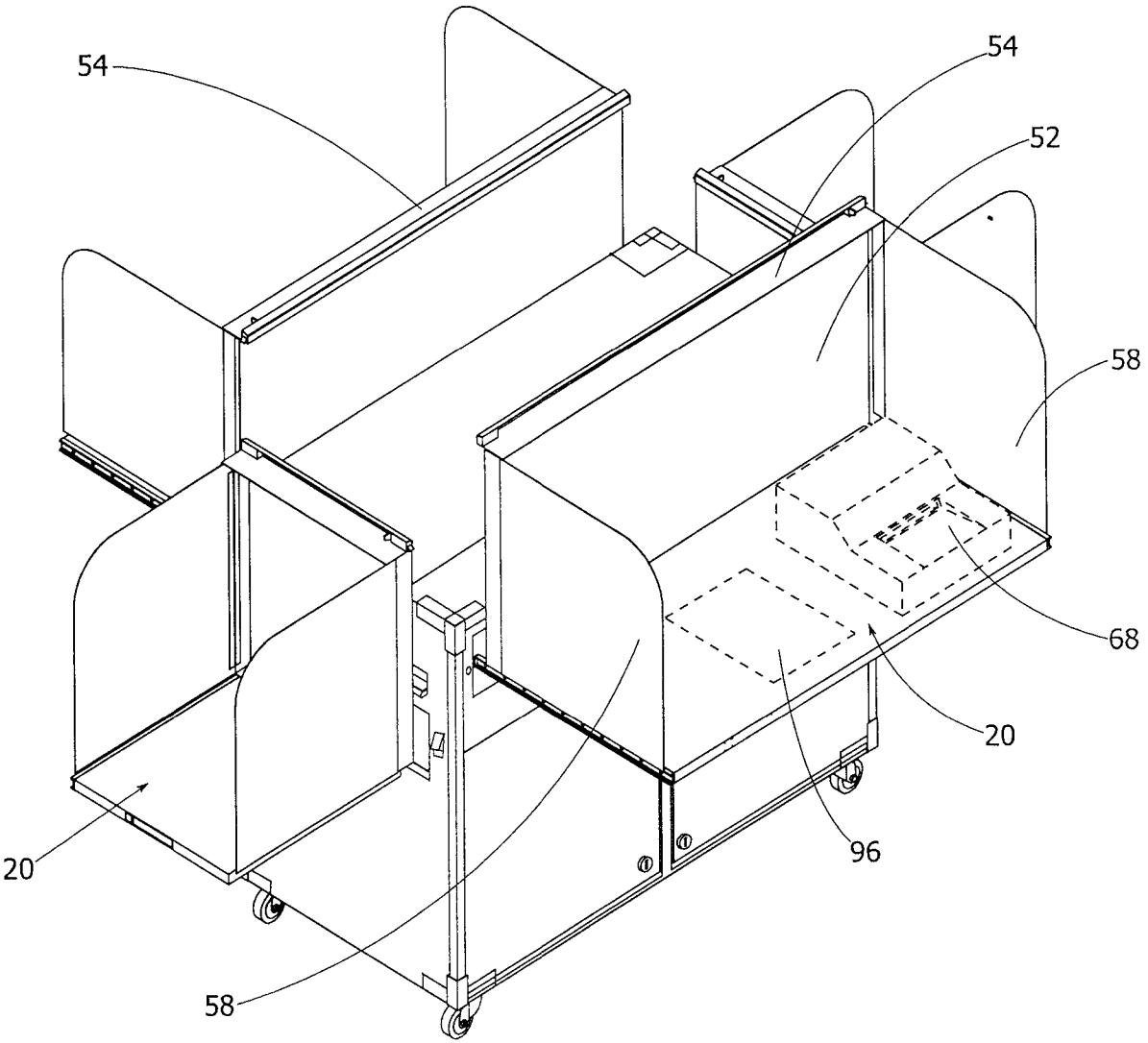
FIG. 37 is a perspective view of one embodiment of the instant invention.

FIG. 37 illustrates an embodiment wherein the voting tray is constructed to have sufficient width to be utilized for filling out a voting ballot in area 96 and containing optical scanner 68 onto one single tray 20. These trays are constructed the same as the narrow trays but simply include a different width. In this manner, the voter can fill out a ballot and place the ballot into the scanner device 68 without the need for transporting the filled ballot to a different location.

Figure 38:
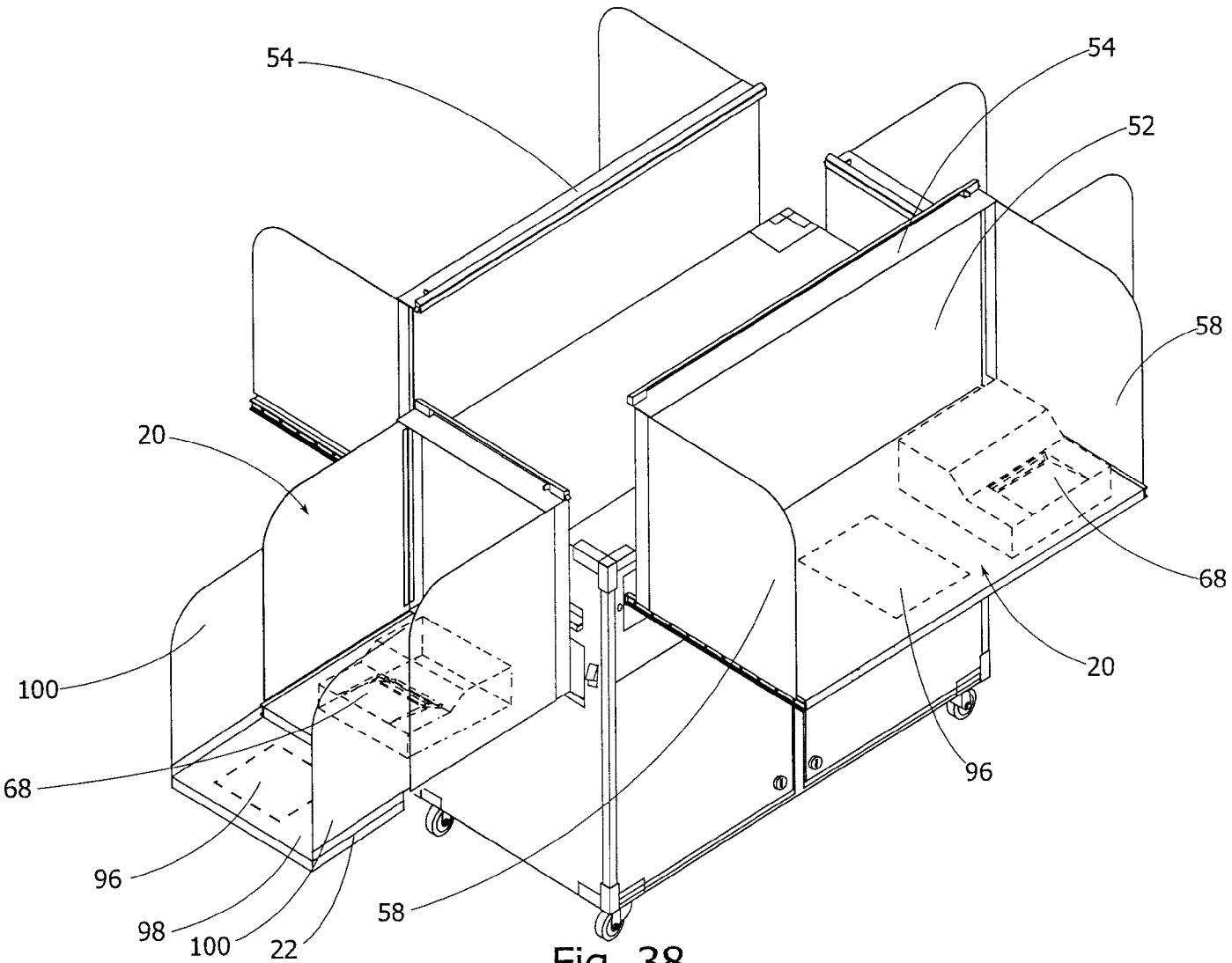
FIG. 38 is a perspective view of one embodiment of the instant invention.

FIG. 38 illustrates an alternative embodiment of the voting cart 10. In this embodiment, the trays 20 on the front and rear of the voting cart are constructed to include sufficient width to have ballot marking area 96 and optical scanning counter 68 arranged horizontally in line within a single tray 20. The side trays 20 are constructed and arranged to include a secondary tray 98 which preferably includes sliding tracks 22. This configuration provides a ballot marking area 96 and optical scanner unit 68 arranged vertically in line within a single voting tray. Secondary privacy shields 100 are provided to extend the side panel privacy shields 58.

Figure 39:
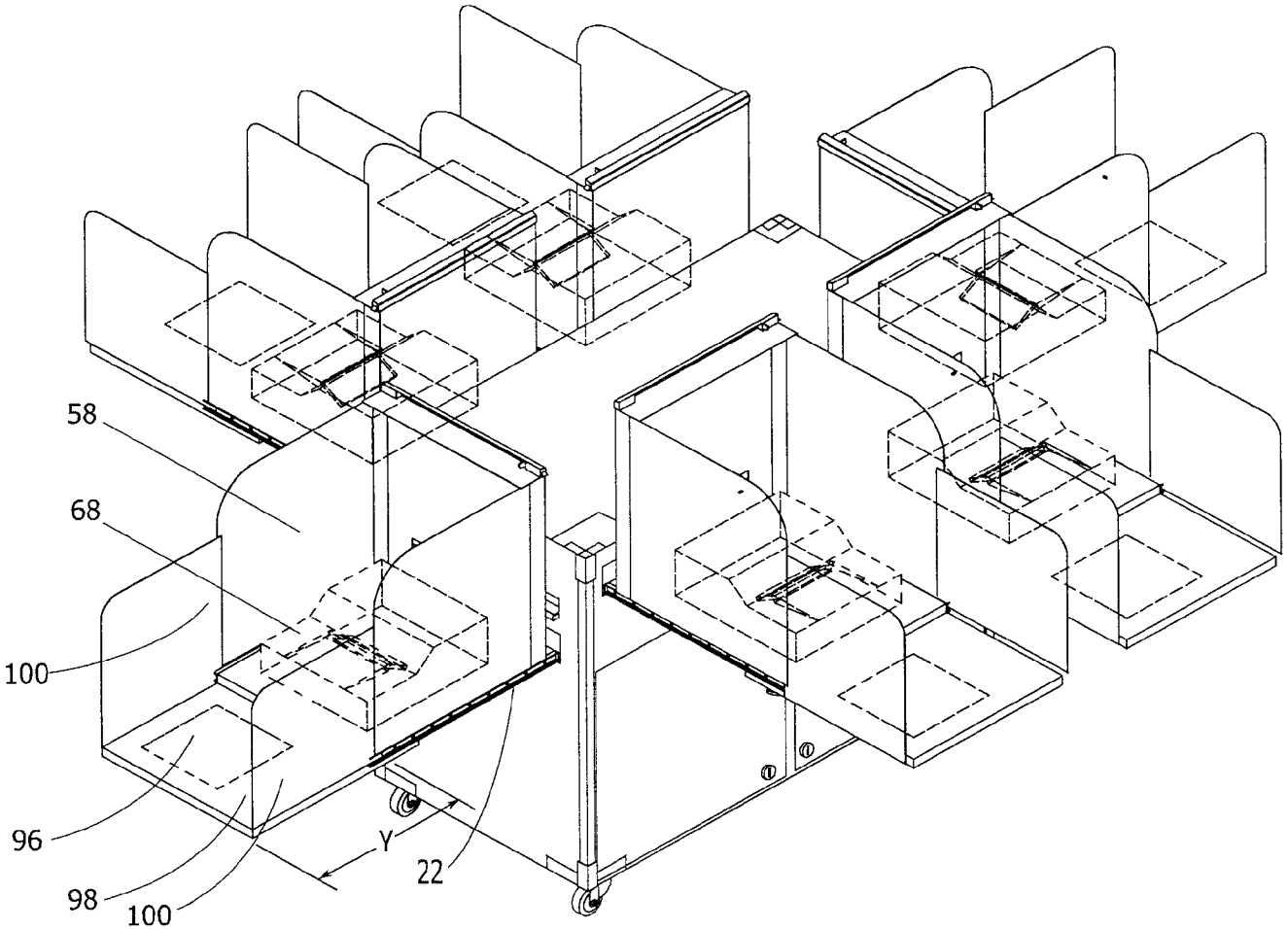
FIG. 39 is a six station voting booth device.

FIG. 39 illustrates an alternative embodiment of the voting cart 10. In this embodiment, each of the voting trays 20 are provided with the secondary trays 98 and the secondary side shields 100 which allow the ballot area 96 and the optical scanner unit counter to be positioned on single tray 20. The additional secondary tray and privacy shields can be adjusted with varying lengths with respect to the scanner unit table as illustrated in FIG. 39 a Y (gamma-varying length).

Figure 40:
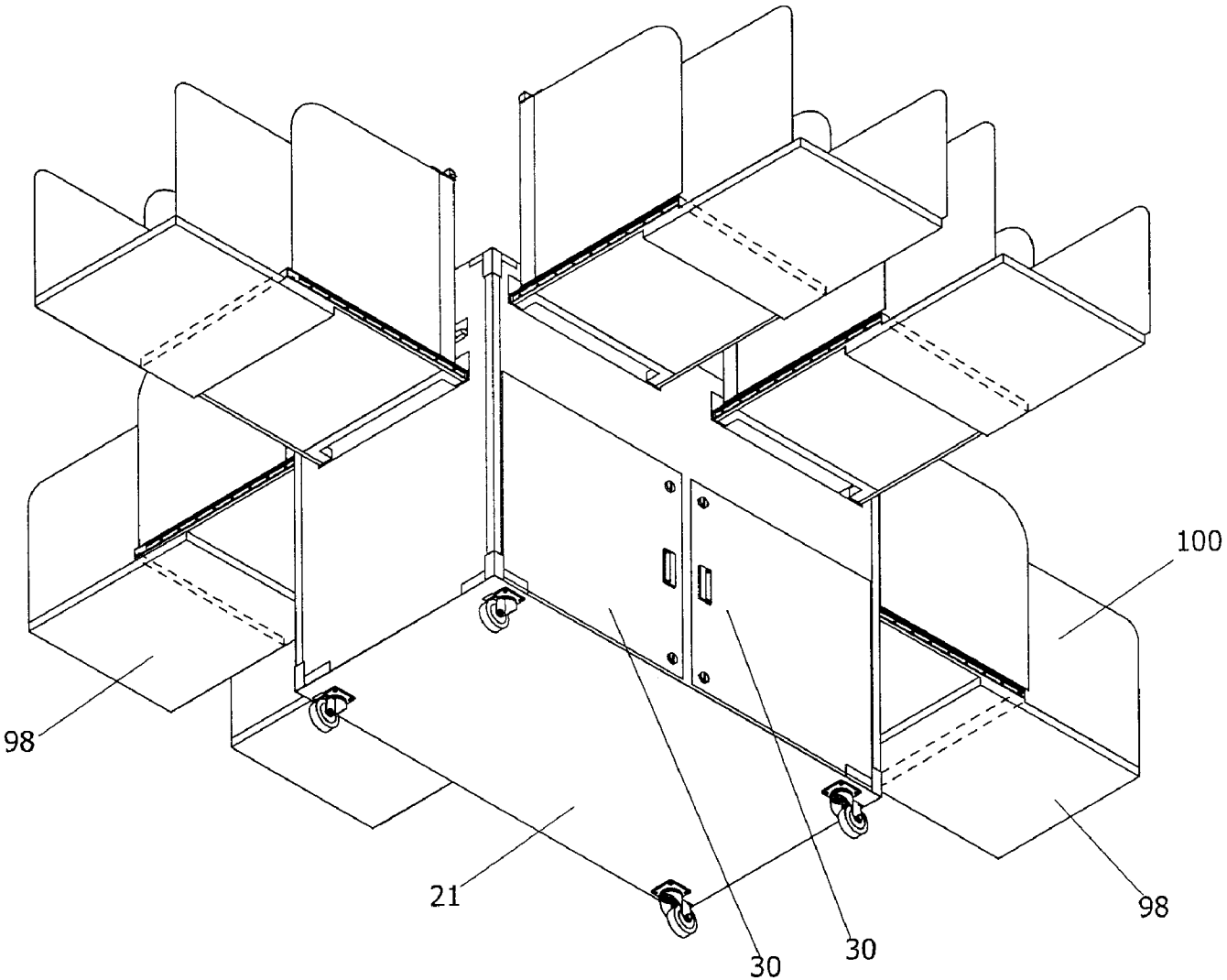
FIG. 40 is a bottom view of the embodiment illustrated in FIG. 39.

FIG. 40 illustrates an underside of FIG. 39 with the additional secondary voting trays 98. The additional voting booth is used as a paper ballot marking table and it slides independently underneath the tray as shown.

Figure 41:
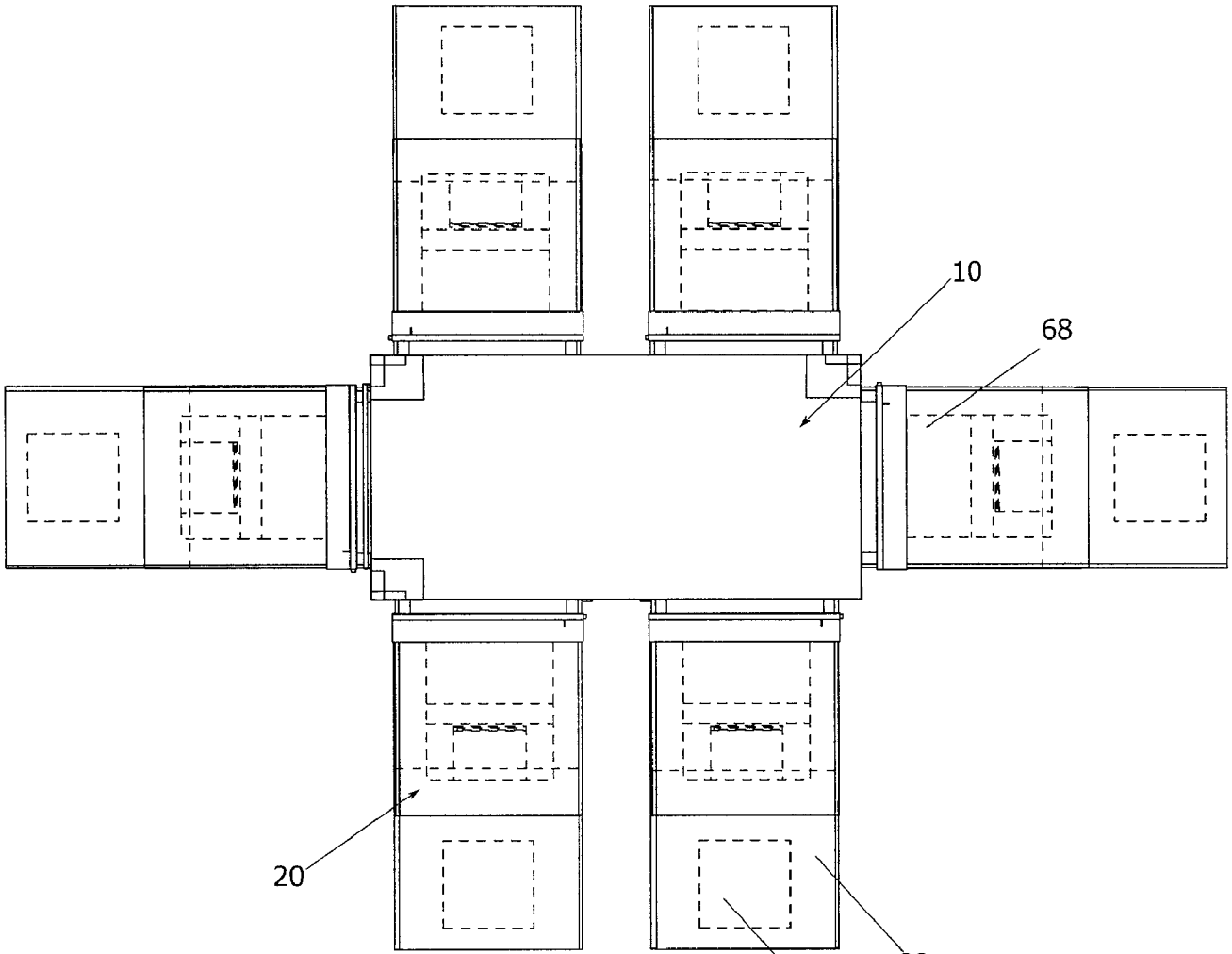
FIG. 41 is a top view of one embodiment of a 6 station voting cart device.

FIG. 41 is a top view illustrating the embodiment shown in FIGS. 39-40.

Figure 42:
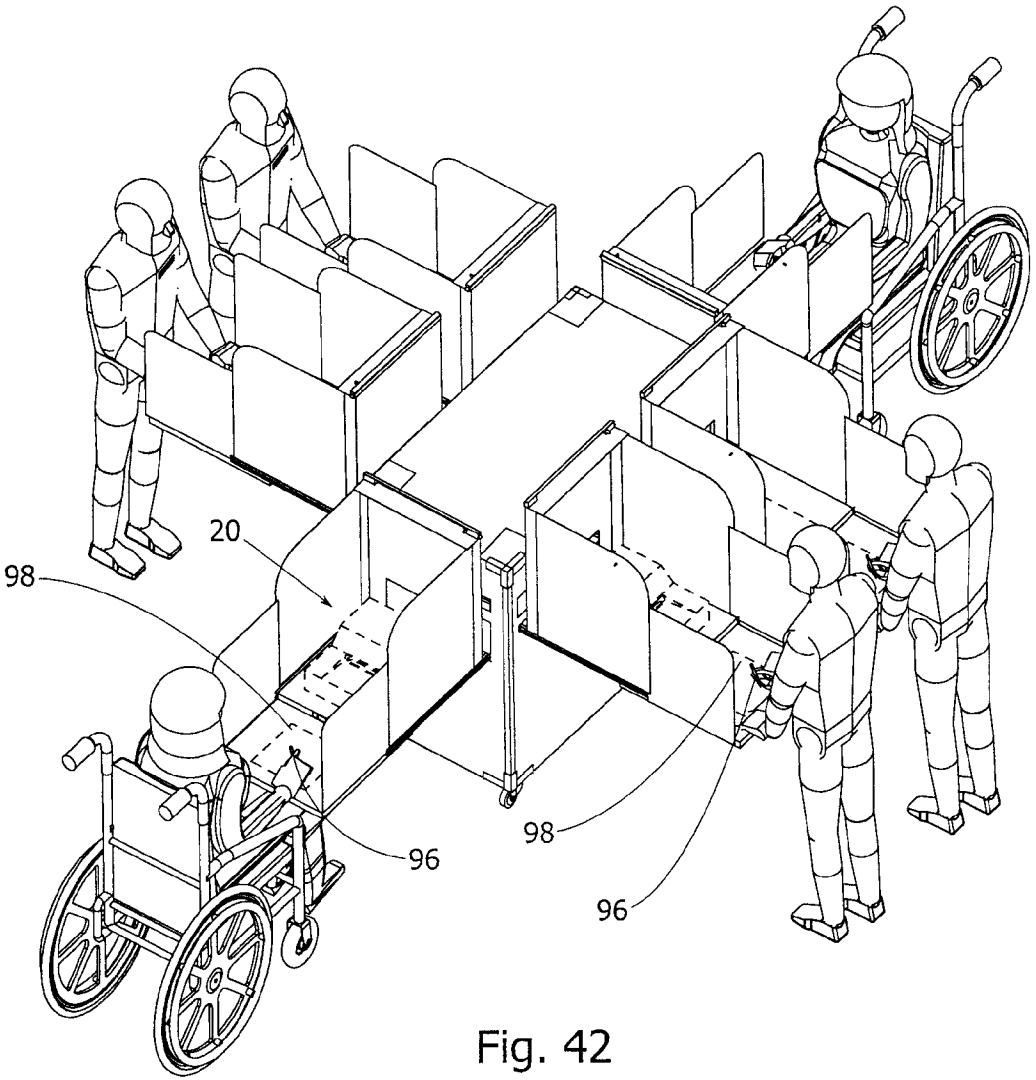
FIG. 42 is a top perspective view of one embodiment of the voting cart device.
Figure 43:
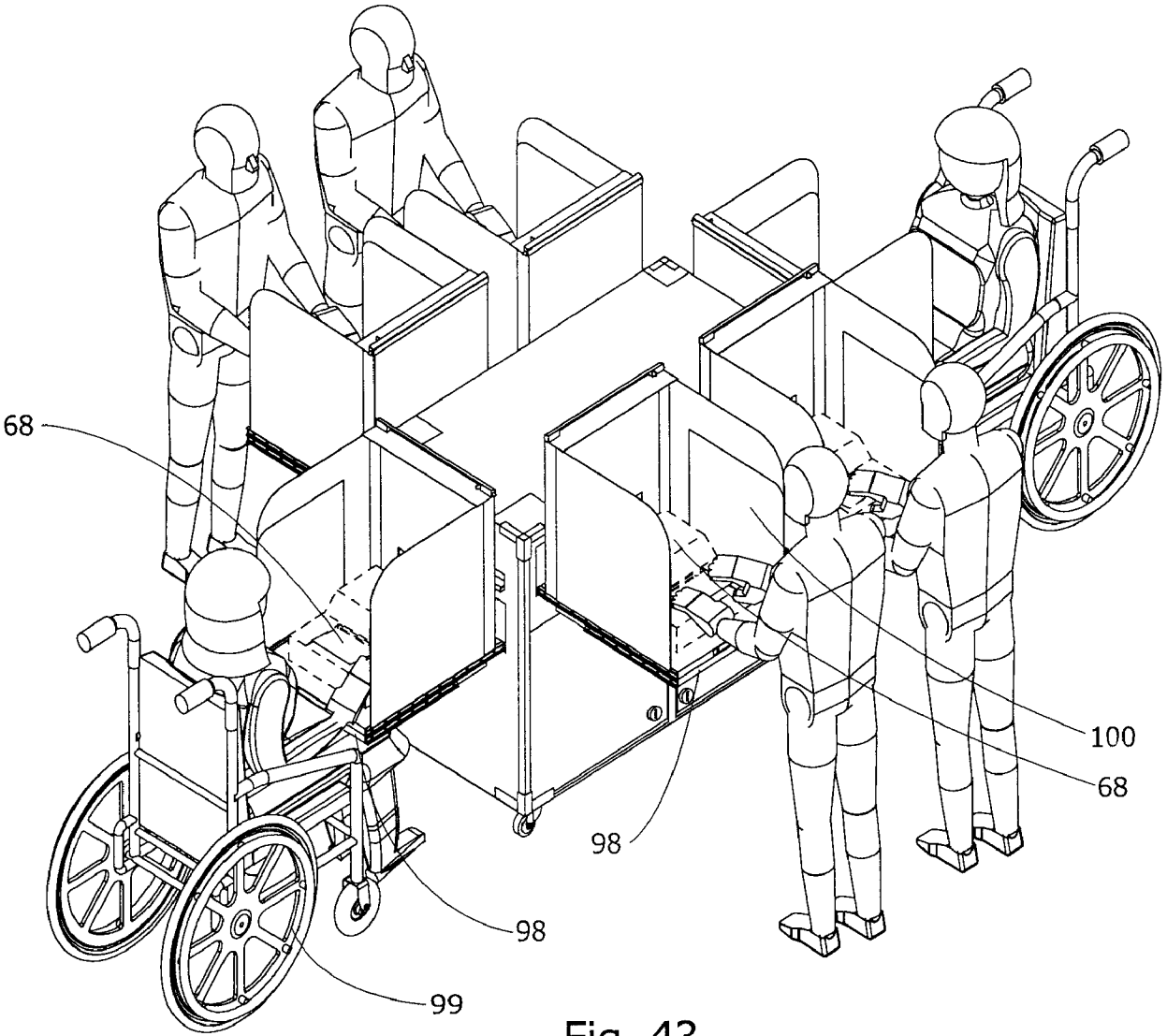
FIG. 43 is a top perspective view of one embodiment of the voting cart device.

FIGS. 42 and 43 illustrate operation of the embodiment shown in FIGS. 39-41. In this embodiment, voters can fill in their ballot utilizing the ballot area 96, as illustrated in FIG. 42, and thereafter they may slide the secondary tray 98 underneath the primary tray 20 to provide better access to the optical scanning device 68 as illustrated in FIG. 43.

An electronic sensor system 329 is provided on the cart to monitor the stationeries, accessories, etc. contained within the cart. This helps to assure that all the necessary equipment, stationeries, accessories, etc. are in the cart prior to it being deployed.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The invention claimed is:

1. A voting cart comprising:

a structural frame for providing rigidity to said voting cart, said structural frame having a front surface, a rear surface, a pair of side surfaces, a top surface and a bottom surface, at least one of said side, front or rear surfaces including a tray opening sized and shaped for passage of a voting tray, said voting cart including a storage area therein, said front surface including at least one door for providing access to said storage area, said storage area including at least one sensor for monitoring the contents of said storage area, said at least one sensor is an RFID tag located on contents within said cart which are to be tracked;

a plurality of wheels secured to said bottom surface for transport of said voting cart;

at least one voting tray, sized and shaped for passage through a tray opening, said at least one voting tray moveable between a storage position for transport of said voting cart and a deployed position for use as a voting surface.

2. The voting cart of claim 1 wherein said at least one voting tray includes a carrel style privacy shield.

3. The voting cart of claim 2 wherein said privacy shield includes a rear panel member pivotally secured to an upper surface of said at least one voting tray and a pair of side panels hingedly secured to said rear panel, whereby said privacy shield is configurable between a storage position and a deployed position.

4. The voting cart of claim 1 wherein said at least one voting tray is secured to a sliding track for movement between said storage and said deployed positions.

5. The voting cart of claim 1 wherein said structural frame includes a front panel, a rear panel, a pair of side panels, a top panel and a bottom panel enclosing said voting cart.

6. A voting cart comprising:

a structural frame for providing rigidity to said voting cart, said structural frame having a front surface, a rear surface, a pair of side surfaces, a top surface and a bottom surface, at least one of said side, front or rear surfaces including a tray opening sized and shaped for passage of a voting tray;

a plurality of wheels secured to said bottom surface for transport of said voting cart;

at least one voting tray, sized and shaped for passage through a tray opening, said at least one voting tray moveable between a storage position for transport of said voting cart and a deployed position for use as a voting surface;

said voting cart including a tracking system secured to said voting cart, said tracking system constructed and arranged to report the position of said cart upon demand.

7. A voting cart comprising:

a structural frame for providing rigidity to said voting cart, said structural frame having a front surface, a rear surface, a pair of side surfaces, a top surface and a bottom surface, at least one of said side, front or rear surfaces including a tray opening sized and shaped for passage of a voting tray;

a plurality of wheels secured to said bottom surface for transport of said voting cart;

at least one voting tray, sized and shaped for passage through a tray opening, said at least one voting tray moveable between a storage position for transport of said voting cart and a deployed position for use as a voting surface;

said voting cart including a customized ballot collection box with varying height.

8. The voting cart of claim 1 wherein said at least one sensor is a weight sensor.

9. The voting cart of claim 6 wherein said tracking system is a GPS tracking system, said tracking system constructed and arranged to communicate with a cellular telephone, whereby the location of said cart can be determined in real time.

10. The voting cart of claim 1 including a central braking system for said plurality of wheels, said central braking system being operable from a single location with respect to said cart for operation of more than one brake.

11. The voting system of claim 1 wherein said voting cart includes a plurality of said voting trays.

12. The voting cart of claim 11 wherein said plurality of voting trays are positioned at different heights with respect to a ground surface whereby said trays are positioned in a vertically overlapping arrangement when in said storage position to provide a compact arrangement.

13. The voting cart of claim 1 wherein said voting surface includes a sufficient width for a portion of said voting surface to be utilized for supporting an electronic scanning device.

14. The voting cart of claim 1 wherein said at least one voting tray is pivotally secured to said structural frame for movement between a storage position and a deployed position.

15. The voting cart of claim 1 including a lock adjacent each said at least one voting trays, said lock providing secured access to each said voting tray.

16. The voting cart of claim 1 wherein said at least one voting tray has a LCD display screen for instructing the voters on voting procedures.

17. The voting cart of claim 7 wherein said ballot collection box has at least one inlet chutes for guiding the marked ballot paper from the electronic scanner to the ballot box collection area.

18. The voting cart of claim 7 wherein said ballot collection box has at least one storage access door provided with lock and latch for gaining access to the interior of the ballot box for securing the contents of it.

19. The voting cart of claim 7 wherein said ballot collection box is secured along a sliding track system for easy access.

20. A voting cart comprising:

a structural frame for providing rigidity to said voting cart, said structural frame having a front surface, a rear surface, a pair of side surfaces, a top surface and a bottom surface, at least one of said side, front or rear surfaces including a tray opening sized and shaped for passage of a voting tray, said voting cart including a storage area therein, said front surface including at least one door for providing access to said storage area, said storage area including at least one sensor for monitoring the contents of said storage area, said at least one sensor is a LDR light beam sensor;

a plurality of wheels secured to said bottom surface for transport of said voting cart;

at least one voting tray, sized and shaped for passage through a tray opening, said at least one voting tray moveable between a storage position for transport of said voting cart and a deployed position for use as a voting surface.

21. A voting cart comprising:

a structural frame for providing rigidity to said voting cart, said structural frame having a front surface, a rear surface, a pair of side surfaces, a top surface and a bottom surface, at least one of said side, front or rear surfaces including a tray opening sized and shaped for passage of a voting tray, said voting cart including a storage area therein, said front surface including at least one door for providing access to said storage area, said storage area including at least one sensor for monitoring the contents of said storage area, said at least one sensor is a weight sensor;

a plurality of wheels secured to said bottom surface for transport of said voting cart;

at least one voting tray, sized and shaped for passage through a tray opening, said at least one voting tray moveable between a storage position for transport of said voting cart and a deployed position for use as a voting surface.

22. A voting cart comprising:

a structural frame for providing rigidity to said voting cart, said structural frame having a front surface, a rear surface, a pair of side surfaces, a top surface and a bottom surface, at least one of said side, front or rear surfaces including a tray opening sized and shaped for passage of a voting tray;

a plurality of wheels secured to said bottom surface for transport of said voting cart;

at least one voting tray, sized and shaped for passage through a tray opening, said at least one voting tray moveable between a storage position for transport of said voting cart and a deployed position for use as a voting surface, said at least one voting tray including a secondary tray slidably secured thereto for extending the length of said voting surface, wherein a portion of said extended length voting surface is utilized for supporting an electronic scanning device.

23. A voting cart comprising:

a structural frame for providing rigidity to said voting cart, said structural frame having a front surface, a rear surface, a pair of side surfaces, a top surface and a bottom surface, at least one of said side, front or rear surfaces including a tray opening sized and shaped for passage of a voting tray;

a plurality of wheels secured to said bottom surface for transport of said voting cart;

at least one voting tray, sized and shaped for passage through a tray opening, said at least one voting tray moveable between a storage position for transport of said voting cart and a deployed position for use as a voting surface, said at least one voting tray including a push button activated servo controlled mechanism for deploying and retracting said at least one voting tray.

24. A voting cart comprising:

a structural frame for providing rigidity to said voting cart, said structural frame having a front surface, a rear surface, a pair of side surfaces, a top surface and a bottom surface, at least one of said side, front or rear surfaces including a tray opening sized and shaped for passage of a voting tray;

a plurality of wheels secured to said bottom surface for transport of said voting cart;

at least one voting tray, sized and shaped for passage through a tray opening, said at least one voting tray moveable between a storage position for transport of said voting cart and a deployed position for use as a voting surface;

said voting cart including a central lock system, said central lock system operable to lock and unlock each said at least one tray from a single location.

25. A voting cart comprising:

a structural frame for providing rigidity to said voting cart, said structural frame having a front surface, a rear surface, a pair of side surfaces, a top surface and a bottom surface, at least one of said side, front or rear surfaces including a tray opening sized and shaped for passage of a voting tray;

a plurality of wheels secured to said bottom surface for transport of said voting cart;

at least one voting tray, sized and shaped for passage through a tray opening, said at least one voting tray moveable between a storage position for transport of said voting cart and a deployed position for use as a voting surface, said at least one voting tray having a time and brightness adjustable and rotatable motion sensor LED light for illumination.

* * * * *